US009261045B2

(12) United States Patent
Kisaichi et al.

(10) Patent No.: US 9,261,045 B2
(45) Date of Patent: Feb. 16, 2016

(54) CASING STRUCTURE FOR AN INTERNAL COMBUSTION ENGINE

(71) Applicant: HONDA MOTOR CO., LTD., Tokyo (JP)

(72) Inventors: Toru Kisaichi, Asaka (JP); Hiroshi Sotani, Tsurugashima (JP)

(73) Assignee: Honda Motor Co., Ltd., Tokyo (JP)

( * ) Notice: Subject to any disclaimer, the term of this patent is extended or adjusted under 35 U.S.C. 154(b) by 11 days.

(21) Appl. No.: 14/105,699

(22) Filed: Dec. 13, 2013

(65) Prior Publication Data

US 2014/0174397 A1 Jun. 26, 2014

(30) Foreign Application Priority Data

Dec. 26, 2012 (JP) ..... 2012-282102

(51) Int. Cl.
*F02F 7/00* (2006.01)

(52) U.S. Cl.
CPC ..... *F02F 7/0043* (2013.01)

(58) Field of Classification Search
CPC ..... F02F 7/0053; F02F 7/0039; F02F 7/0043; F02F 7/0058; F02F 1/243; B60K 17/08; B60K 5/04
USPC ..... 123/195 R, 195 H, 195 AC
See application file for complete search history.

(56) References Cited

U.S. PATENT DOCUMENTS 4,798,254 A * 1/1989 Lings ..... B60G 3/24 123/184.42
4,945,866 A * 8/1990 Chabot, Jr. ..... 123/53.1
5,076,220 A * 12/1991 Evans et al. ..... 123/65 VC
5,078,105 A * 1/1992 Ito ..... F02B 61/02 123/195 AC
5,099,945 A * 3/1992 Okui ..... B60K 5/04 123/90.31
5,184,582 A * 2/1993 Okui ..... B60K 5/04 123/90.27
5,445,548 A * 8/1995 Koishikawa et al. ..... 440/89 R
5,887,563 A * 3/1999 Shudo ..... F01M 11/065 123/196 R
6,612,281 B1 * 9/2003 Martin ..... F02B 41/04 123/197.4
6,708,664 B2 * 3/2004 Ito ..... F02B 75/20 123/196 R
8,061,467 B2 11/2011 Takeshima et al.
8,245,672 B2 * 8/2012 Yokoi ..... B62K 11/04 123/193.2
2002/0104504 A1 * 8/2002 Suzuki ..... F02B 61/02 123/195 R
2003/0140888 A1 * 7/2003 Tanaka et al. ..... 123/196 R
2005/0081664 A1 * 4/2005 Kawakubo ..... F16H 3/089 74/337.5
2007/0074681 A1 * 4/2007 Shiozaki ..... F01P 7/16 123/41.1

(Continued)

FOREIGN PATENT DOCUMENTS

JP 11082019 A * 3/1999
JP 2000282884 A * 10/2000

(Continued)

*Primary Examiner* — Marguerite McMahon
*Assistant Examiner* — Tea Holbrook
(74) *Attorney, Agent, or Firm* — Honda Patents & Technologies North America, LLC; Clifford B Vaterlaus

(57) ABSTRACT

A casing structure of an automotive internal combustion engine includes an upper/lower divided crankcase structure. A crankshaft and a first transmission shaft of a pair of transmission shafts parallel to the crankshaft of a transmission are axially supported by a dividing surface of the upper crankcase and the lower crankcase. The dividing surface of the crankcase is inclined so that a second transmission shaft axially supported by the upper crankcase above the first transmission shaft is below the crankshaft. A cylinder is formed on the upper crankcase so that a cylinder axial line is orthogonal to the dividing surface.

20 Claims, 13 Drawing Sheets

(56) References Cited

U.S. PATENT DOCUMENTS

2007/0107688 A1* 5/2007 Matsuda ..... F01M 13/04 123/192.2
2007/0221160 A1* 9/2007 Haze ..... F02B 75/20 123/197.1
2007/0245999 A1* 10/2007 Sato ..... F16H 61/0009 123/196 CP
2008/0076585 A1* 3/2008 Inui ..... B60K 17/08 464/179
2008/0314677 A1* 12/2008 Shiozaki ..... F02B 61/02 180/366
2009/0084338 A1* 4/2009 Tsubakino ..... F01L 1/053 123/190.1
2010/0072018 A1* 3/2010 Tsukada ..... F16D 21/06 192/48.611
2012/0067320 A1* 3/2012 Kawamata et al. ..... 123/196 R
2014/0174397 A1* 6/2014 Kisaichi et al. ..... 123/195 R

FOREIGN PATENT DOCUMENTS

JP 2002122028 A * 4/2002
JP 2008-056109 3/2008
JP 2010-228739 10/2010

* cited by examiner

Fig. 12
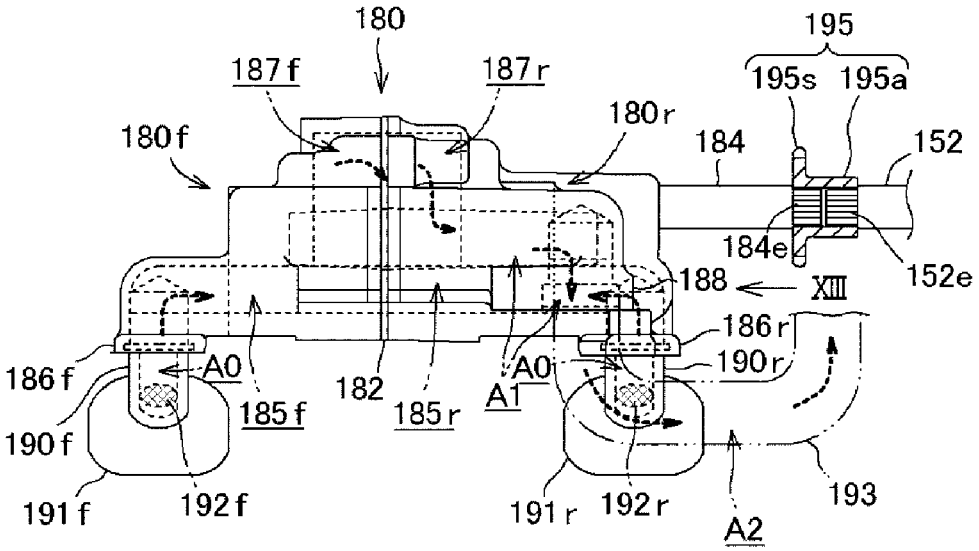
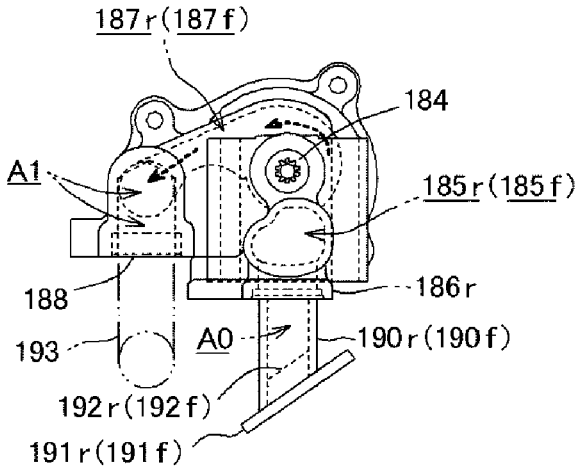
Fig. 13

CASING STRUCTURE FOR AN INTERNAL COMBUSTION ENGINE

CROSS REFERENCE TO RELATED APPLICATIONS

The present application claims priority under 35 U.S.C. §119 to Japanese Patent Application No. 2012-282102, filed on Dec. 26, 2012, entitled "A Casing Structure of an Internal Combustion Engine for Vehicles," the contents of which are incorporated herein by reference in their entirety.

BACKGROUND

The present disclosure relates to a casing structure of an automotive internal combustion engine including an upper/lower divided crankcase structure.

In the upper/lower divided crankcase structure for an internal combustion engine, normally, an upper crankcase and a lower crankcase axially support a crankshaft and a transmission shaft of a transmission so as to be sandwiched at a dividing surface.

One known internal combustion engine has a general structure where the upper crankcase and lower crankcase axially support the crankshaft and a counter shaft of the transmission so as to be sandwiched at the dividing surface. The engine is installed in a vehicle so that the dividing surface forms a horizontal plane.

Further, the cylinder axial line of the cylinder formed on the upper crankcase is inclined to the transmission side so that the overall vertical dimension of the internal composition engine is kept small by inclining the cylinder, cylinder head, and cylinder cover that are sequentially overlaid upwardly.

In a known automotive internal combustion engine, a main shaft of a transmission is installed above and between the counter shaft and the crankshaft axially supported by the dividing surface of the upper crankcase and lower crankcase.

The transmission case portion of the upper crankcase bulges upward due to the main shaft and accessories and the like provided on the main shaft. Therefore, the incline of the cylinder axial line is restricted, thereby limiting the reduction in the overall vertical dimension of the internal combustion engine.

Further, the upper crankcase has a cylinder formed inclined relative to the dividing surface with the lower crankcase. Therefore, bolt holes must also be formed to incline relative to the dividing surface for bolts to integrally fasten the cylinder head laid over the cylinder. This increases the complexity of manufacturing the crankcase.

SUMMARY

In light of the foregoing, an aspect of the present disclosure is to provide a casing structure of an internal combustion engine having excellent crankcase manufactureability that can keep the overall vertical dimension of an internal combustion engine small by significantly inclining the cylinder axial line.

In order to achieve the above, a first aspect of the present disclosure may include a casing structure of an internal combustion engine including an upper/lower divided crankcase structure. A crankshaft (21) and a first transmission shaft (32) of a pair of transmission shafts (31, 32) parallel to the crankshaft (21) of a transmission (Tm) may be axially supported by a dividing surface (S) of an upper crankcase (23) and a lower crankcase (22). The dividing surface (S) of the crankcase (23) may be inclined so that a second transmission shaft (31) axially supported by the upper crankcase (23) above the first transmission shaft (32) is below the crankshaft (21). A cylinder (Cy) may be formed on the upper crankcase (23) so that a cylinder axial line (L) may be orthogonal to the dividing surface (S).

With the casing structure of an automotive internal combustion engine according to the first aspect, because, in the casing structure of an automotive internal combustion engine including an upper/lower divided crankcase structure, a crankshaft (21) and a first transmission shaft (32) are disposed on a dividing surface (S), the dividing surface (S) of the crankcases (22, 23) may be inclined so that a second transmission shaft (31) above the first transmission shaft (32) may be below the crankshaft (21) and a cylinder (Cy) may be formed on the upper crankcase (23) so that a cylinder axial line (L) is orthogonal to the dividing surface (S). The cylinder axial line (L) can be even more inclined with the dividing surface (S) without interfering with the cylinder (Cy) even if the transmission case portion of the upper crankcase (23) bulges upward due to the second transmission shaft (31) and accessories (30) provided on the second transmission shaft (31), thereby enabling the overall vertical dimension of the internal combustion engine (E) to be kept even smaller.

Further, because the cylinder (Cy) may be formed on the upper crankcase (23) so that the cylinder axial line (L) is orthogonal to the dividing surface (S), manufacturability of the crankcases (22, 23) is favorable.

A second aspect of the present disclosure may include the casing structure of an automotive internal combustion engine according to the first aspect, wherein the cylinder axial line (L) of the cylinder (Cy) is offset to the transmission (Tm) side relative to the crankshaft (21).

With the casing structure of an automotive internal combustion engine according to the second aspect, because the cylinder axial line (L) of the cylinder (Cy) is offset to the transmission (Tm) side relative to the crankshaft (21), side pressure acting on the cylinder inner wall by a piston (26) through a connecting rod (27) can be mitigated, thereby reducing friction loss.

When forming the offset cylinder on the crankcases (22, 23) by displacing the cylinder axial line (L) from the crankshaft (21) because the cylinder axial line (L) is orthogonal to the dividing surface (S), an inclined jig is no longer necessary to manufacture the casing structure, thus providing favorable manufacturability.

A third aspect of the present disclosure may include the casing structure of an automotive internal combustion engine according to the first or second aspect, wherein the lower crankcase (22) has an inner wall (22*t*) that covers the crankshaft (21) from below and is formed parallel to the dividing surface (S), and a scavenge pump (180) is attached to the lower surface of the inner wall (22*t*).

With the casing structure of an automotive internal combustion engine according to the third aspect, because, in the lower crankcase (22), the inner wall (22*t*) that covers the crankshaft (21) from below is formed to be parallel to the dividing surface (S) and the scavenge pump (180) is attached to the lower surface of the inner wall (22*t*), oil traveling on the inclined inner wall (22*t*) parallel to the dividing surface (S) is easily collected in the oil pan (130) below the crankcase, and the oil collected in the oil pan (130) is easily pumped by the scavenge pump (180) attached to the lower surface of the inner wall (22*t*) relatively near to the oil pan (130) to thereby improve lubrication efficiency.

A fourth aspect of the present disclosure may include the casing structure of an automotive internal combustion engine according to any of the first to third aspects, wherein a cylinder head (24) laid over the cylinder (Cy) of the upper crankcase (23) with the inclined cylinder axial line (L) has an intake port (121*i*), extended curving from a combustion chamber (120), that opens to an upper side surface (24*u*) facing obliquely upward of the cylinder head (24). A thermostat chamber (24*t*) for a thermostat (165) that communicates with a water jacket (W6) in the cylinder head (24) may be formed near a curved inner portion that becomes a bottom side of the intake port (121*i*).

With the casing structure of an automotive internal combustion engine according to the fourth aspect, because a cylinder head (24) laid over the cylinder (Cy) of the upper crankcase (23) with the inclined cylinder axial line (L) has an intake port (121*i*), extended curving from a combustion chamber (120), that opens to an upper side surface (24*u*) facing obliquely upward of the cylinder head (24) and a thermostat chamber (24*t*) that communicates with a water jacket (W6) in the cylinder head (24) formed near a curved inner portion that becomes a bottom side of the intake port (121*i*), the thermostat chamber (24*t*) formed on the upper side surface (24*u*) facing obliquely upward of the cylinder head (24) inclined with the cylinder (Cy) is placed in the highest position of a cooling system route higher than a water jacket (W5) of the cylinder (Cy) and the water jacket (W6) of the cylinder head (24) so that air accumulated above the cooling system route can be guided to and collected in the thermostat chamber (24*t*).

Therefore, air bleeding can be performed at the same time as maintenance on the thermostat chamber (24*t*) thereby also improving maintainability.

Moreover, forming the thermostat chamber (24*t*) near the curved inner portion of the bottom side of the intake port (121*i*) prevents the cylinder head (24) from having to be large in size.

A fifth aspect of the present disclosure may include the casing structure of an automotive internal combustion engine according to the fourth aspect, wherein the thermostat chamber (24*t*) is formed on an end portion on a side opposite a cam chain chamber (24*cc*) in a crankshaft direction of the cylinder head (24). A coolant bypass passage (W7) that passes through a curved inner portion that is below the intake port (121*i*) is formed parallel to a crankshaft (21) from the thermostat chamber (24*t*) toward the cam chain chamber (24*cc*).

With the casing structure of an automotive internal combustion engine according to the fifth aspect, because the thermostat chamber (24*t*) is formed on an end portion on a side opposite a cam chain chamber (24*cc*) in a crankshaft direction of the cylinder head (24), the cylinder head (24) is not required to be large in size. Because a coolant bypass passage (W7) is formed using a curved inner portion that is below the intake port (121*i*) by passing through the curved inner portion parallel to the crankshaft (21) that faces the cam chain chamber (24*cc*) from the thermostat chamber (24*t*), a small scale cooling structure can be designed.

A sixth aspect of the present disclosure may include the casing structure of an automotive internal combustion engine according to the fourth or fifth aspect, wherein an exhaust port (121*e*), extended curving from the combustion chamber (120), opens facing an upper space of the transmission (Tm) on a lower side surface (24*d*) that faces obliquely downward of the cylinder head (24).

With the casing structure of an automotive internal combustion engine according to the sixth aspect, because an exhaust port (121*e*), extended curving from the combustion chamber (120), opens facing an upper space of the transmission (Tm) on a lower side surface (24*d*) that faces obliquely downward of the cylinder head (24), an upper space is easily secured to the opening of the exhaust port (121*e*) of the lower side surface (24*d*) facing obliquely downward of the cylinder head (24) over the transmission (Tm) in a relatively lower position having the transmission shaft (31, 32) positioned downward from the crankshaft (21). The exhaust pipe (122*e*) that extends linking to the opening of the exhaust port (121*e*) can be easily and freely handled.

BRIEF DESCRIPTION OF THE DRAWINGS

FIG. 12 is a side view of one embodiment of a scavenge pump.

FIG. 13 is a rear view of the scavenge pump (as viewed from the arrow direction of XIII of FIG. 12).

DETAILED DESCRIPTION

One embodiment will be described below based on FIGS. 1 to 15. However, it will be appreciated that other embodiments are possible within the scope of the present disclosure. A power unit P includes an internal combustion engine E and a power transmission device 20. The power transmission device 20 includes a main transmission Tm and secondary transmission Ts. The power unit P is installed in a vehicle, such as a four-wheel-drive five passenger roofed off-road vehicle 1.

Figure 1:
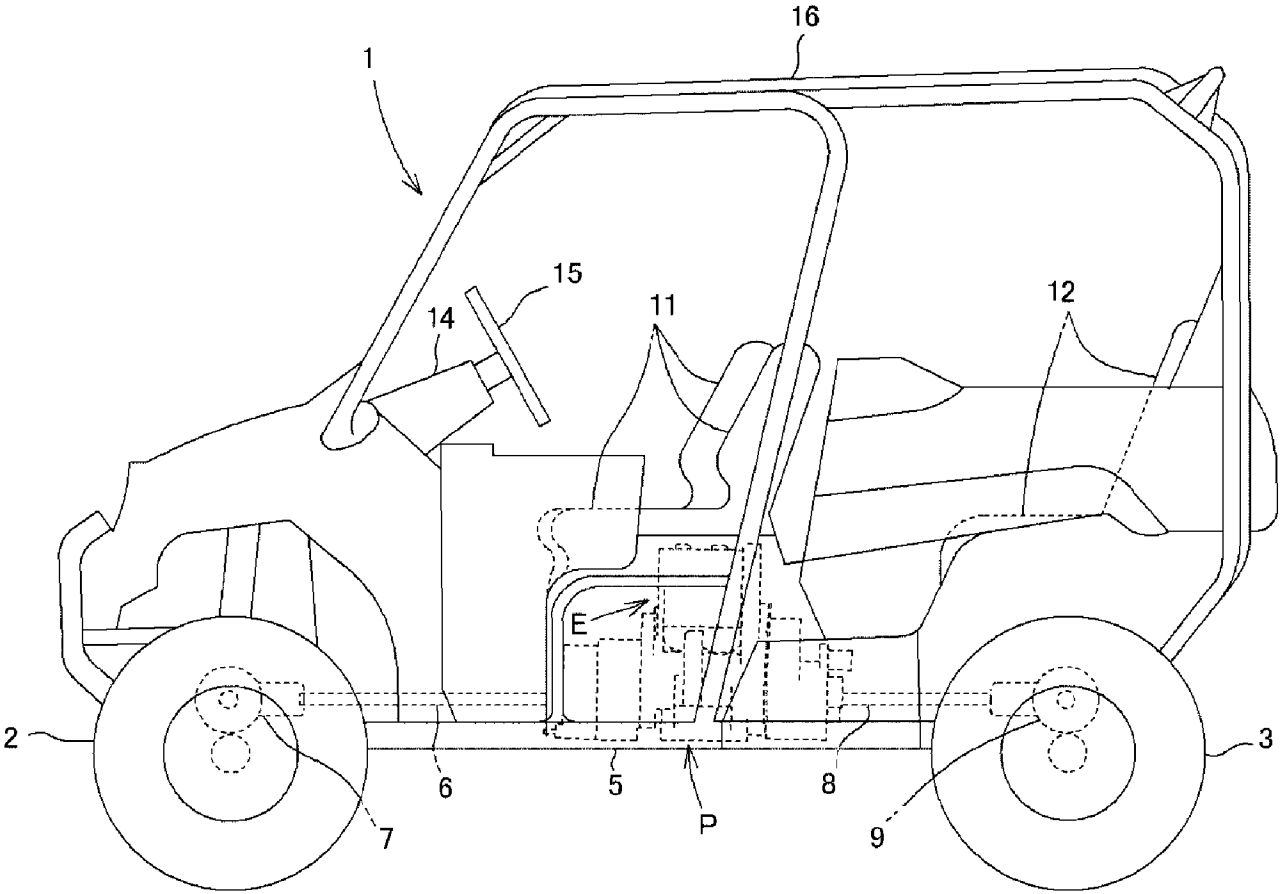
FIG. 1 is a side view of an off-road vehicle equipped with a power unit that incorporates an internal combustion engine according to one embodiment.
Figure 2:
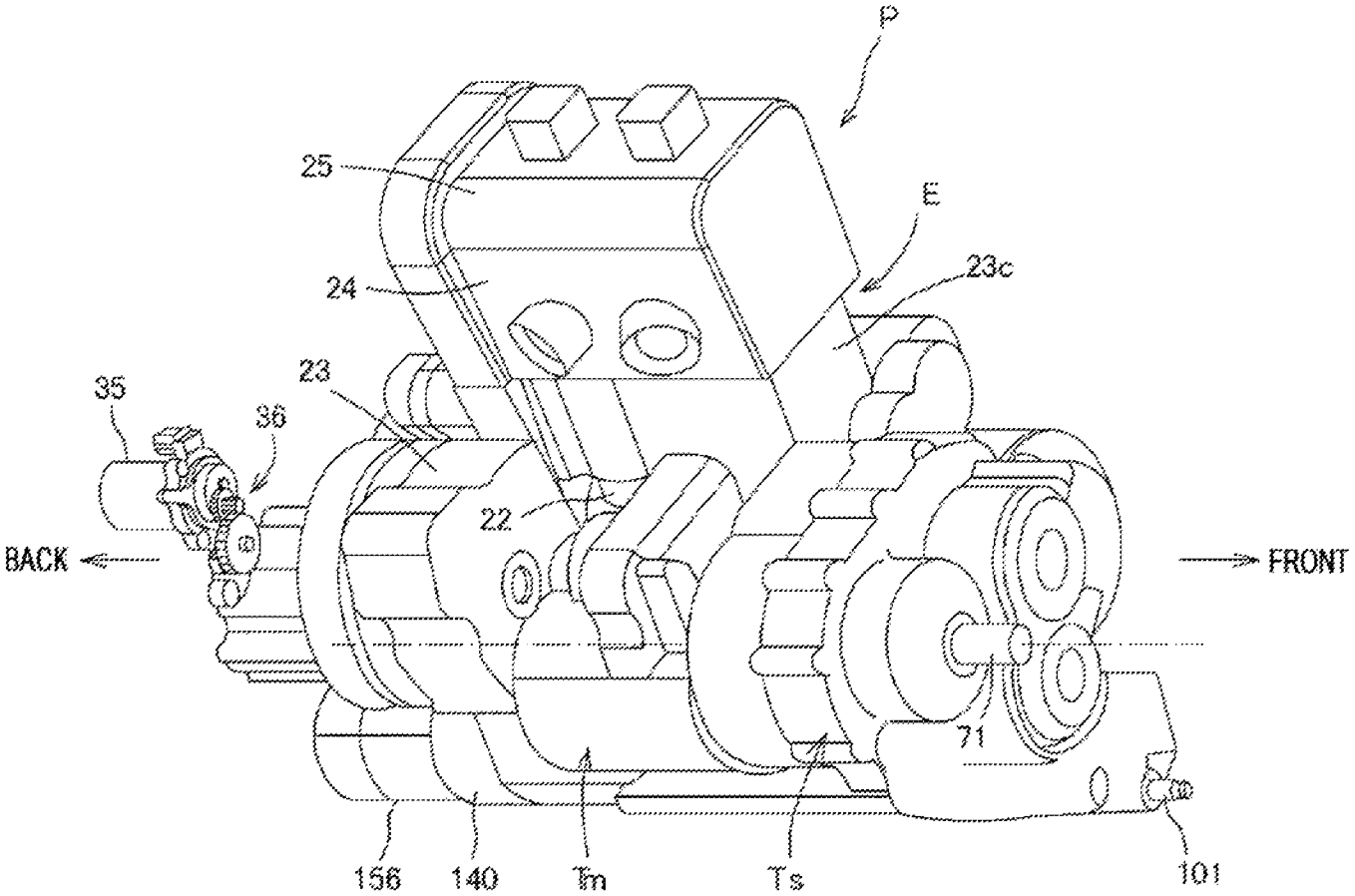
FIG. 2 is an overall perspective view of one embodiment of the power unit.

With reference to FIG. 1, the off-road vehicle 1 has left and right respective pairs of front wheels 2, 2 and rear wheels 3, 3 mounted with low pressure balloon tires for off-road use suspended on the front and rear of a vehicle frame 5.

The power unit P is installed in a front to back center position of the vehicle frame 5 and directs the crankshaft 21 of the internal combustion engine E in a front and back direction. An output shaft 71 of the power unit P protrudes in the front and back of the secondary transmission Ts (see FIGS. 2 and 5). The rotary power of the output shaft 71 is transferred to the left and right front wheels 2, 2 from a front end of the output shaft 71 via a front drive shaft 6 and a front final reduction gear unit 7. The rotary power of the output shaft 71 is transferred to the left and right rear wheels 3, 3 from a rear end via a rear drive shaft 8 and a rear final reduction gear unit 9. A clutch for switching between two-wheel drive and four-wheel drive by disengaging the power transmission to the front wheels is incorporated into the front final reduction gear unit 7.

A front row of seats 11 includes 3 seats arranged left and right above the power unit P. A rear row of seats 12 includes 2 seats arranged left and right in the rear part of the vehicle frame 5. The seat in the center of the front row of seats 11 is disposed to the front slightly more than the seats on the left and the right.

A steering wheel 15 protrudes from a steering column 14 in front of a left side driver's seat. A roof 16 covers the front row of seats 11 and the rear row of seats 12.

One embodiment of the internal combustion engine E is an in-line two-cylinder, water-cooled, four-stroke internal combustion engine, and the power unit P is installed in the vehicle frame 5 in what is known as a vertically placed attitude by directing the crankshaft 21 of the internal combustion engine E in a front and back direction of the vehicle body. It will be understood however, that the concepts of the present disclosure may be used with other types of engines.

The crankcase that axially supports the crankshaft 21 of the internal combustion engine E forms an upper/lower divided crankcase structure including an upper crankcase 23 and a lower crankcase 22. The upper crankcase 23 has a cylinder portion 23*c* extending obliquely to the upper right, and on this, a cylinder head 24 and a cylinder head cover 25 are sequentially, and protrudingly, overlaid (see FIG. 2, FIG. 3, and FIG. 7).

The crankcases 22 and 23 accommodate the main transmission Tm that protrudes to the right. The main transmission Tm is positioned to the right side of the crankshaft 21 of the internal combustion engine E, and a secondary transmission Ts is installed so as to mostly overlap in the front of the main transmission Tm.

Figure 5:
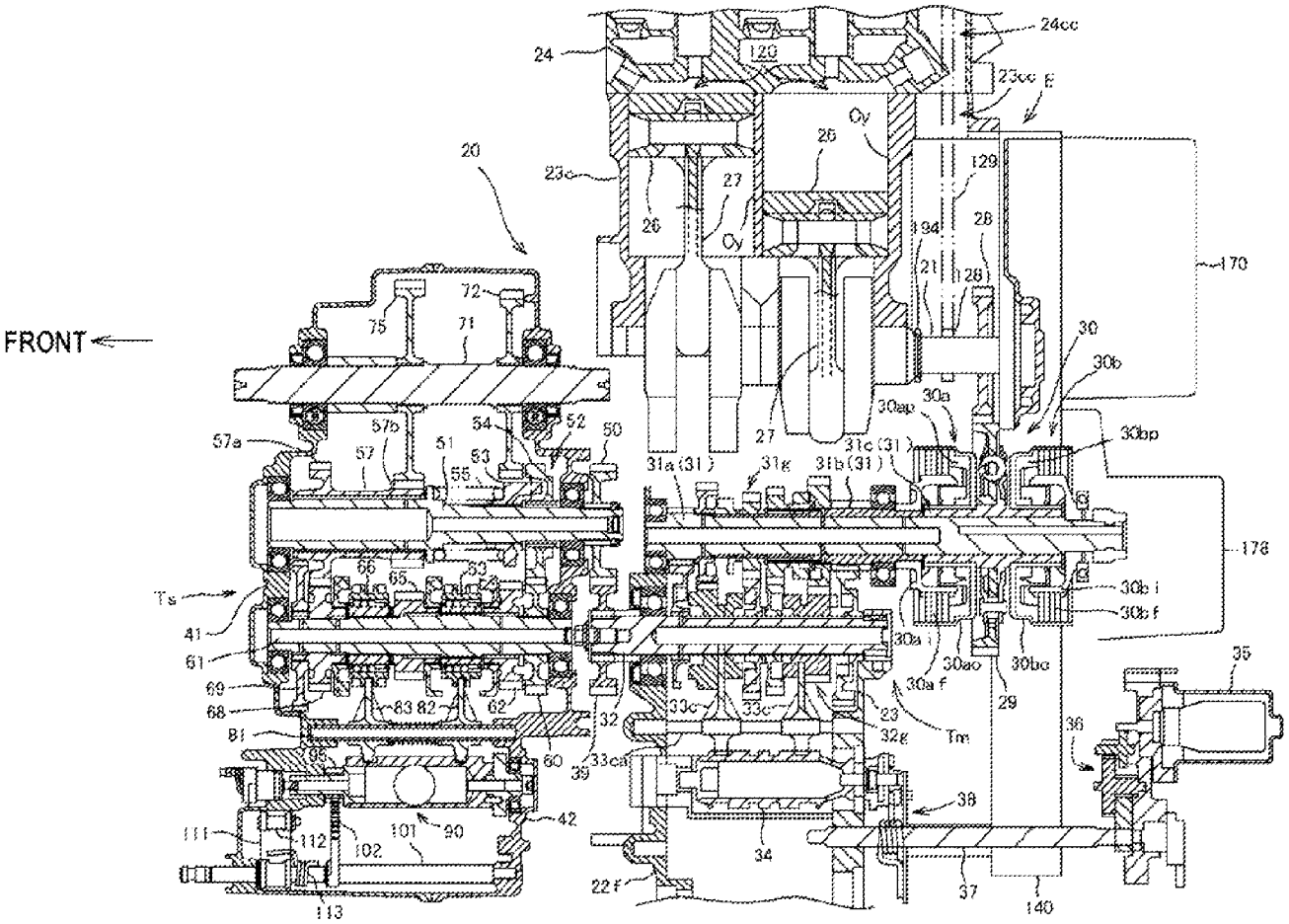
FIG. 5 is a cross-sectional view illustrating a power transmission system of the power unit of FIG. 2.

The overall power transmission device 20 is illustrated in the cross-sectional view of FIG. 5. Two cylinders Cy and Cy are formed in front and rear series on the cylinder portion 23*c* of the upper crankcase 23 of the internal combustion engine E. A connecting rod 27 connects the crankshaft 21 and a piston 26 that reciprocally slides within each cylinder Cy, whereby the reciprocal movement of the piston 26 is converted to rotation of the crankshaft 21 and output.

At the backside portion of the crankshaft 21, sequentially, a primary drive gear 28 is fitted to the back end portion thereof, a drive sprocket 128 is fitted to the front side thereof, and a drive sprocket 194 is fitted to the further front side thereof.

Figure 7:
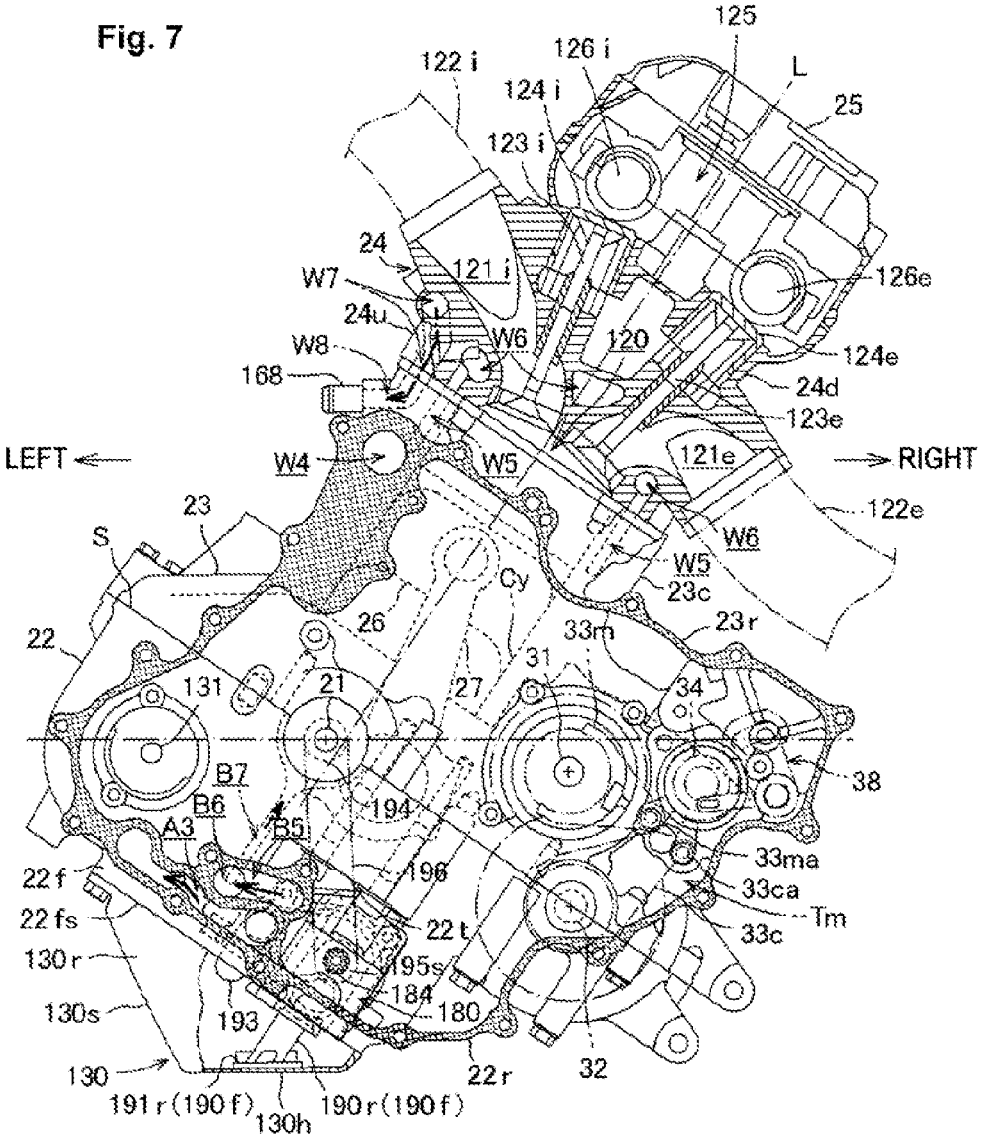
FIG. 7 is a rear view as a partial cross-section of the power unit of FIG. 2, where a casing member and the like have been removed.

With reference to FIG. 7, which is a rear view of the internal combustion engine E, when the internal combustion engine E is in a horizontal attitude with the vehicle, the right side of the dividing surface S of the split upper crankcase 23 and lower crankcase 22 is inclined downward. The main transmission, Tm, includes a main shaft 31 and a counter shaft 32. As shown, the crankshaft 21 and the counter shaft 32 are placed on the inclined dividing surface S. The crankshaft 21 and the counter shaft 32 are sandwiched by the upper crankcase 23 and the lower crankcase 22 and are axially rotatably supported. The main shaft 31 is located above the counter shaft 32 and is axially rotatably supported by the upper crankcase 23.

The main shaft 31, which is positioned above the counter shaft 32, is positioned slightly lower than the crankshaft 21. Specifically, the dividing surface S of the upper crankcase 23 and the lower crankcase 22 that sandwiches the crankshaft 21 and the counter shaft 32 is significantly inclined to the extent that the main shaft 31 above the counter shaft 32 is positioned lower than the crankshaft 21.

The cylinder portion 23*c* of the upper crankcase 23 extends obliquely upward to the right so that the cylinder axial line L, which is the center axial line of the cylinder Cy, is orthogonal to the inclined dividing surface S.

The cylinder portion 23*c*, as illustrated in FIG. 7, is an offset cylinder in which the cylinder axial line L is offset from the crankshaft 21 towards the main transmission Tm side.

With reference to FIG. 5, the main shaft 31 of the main transmission Tm is configured such that the clutch portion outer cylinder 31*c* and the main shaft outer cylinder 31*b* are rotatably fit side-by-side on the outer periphery of the long main shaft inner cylinder 31*a*. Six drive transmission gears 31*g* are provided on the main shaft 31, and six driven transmission gears 32*g* that are constantly meshed with the drive transmission gears 31*g* are provided on the counter shaft 32. The drive transmission gears 31*g* for the odd numbered shift stages are provided on the main shaft inner cylinder 31*a*, and the drive transmission gears 31*g* for the even numbered shift stages are provided on the main shaft outer cylinder 31*b*.

A pair of twin clutches 30 including a first clutch 30*a* and a second clutch 30*b* is configured on the clutch portion outer cylinder 31*c*. A primary driven gear 29 is provided in the center of the clutch portion outer cylinder 31*c* and, on both sides thereof, clutch outers 30*ao* and 30*bo* of the first clutch 30*a* and the second clutch 30*b* are spline fitted for axial movement. The center primary driven gear 29 meshes with the primary drive gear 28 provided on the crankshaft 21.

Further, a clutch inner 30*ai* of the first clutch 30*a* is spline fitted to the main shaft inner cylinder 31*a* for axial movement, and a clutch inner 30*bi* of the second clutch 30*b* is spline fitted to the main shaft outer cylinder 31*b* for axial movement.

Pressure plates 30*ap* (30*bp*) can pressurize friction plate groups 30*af* (30*bf*) in which a drive friction plate that rotates together on the clutch outer 30*ao* (30*bo*) side and a driven friction plate that rotates together on the clutch inner 30*ai* (30*bi*) side are arrayed alternately.

A hydraulic circuit that selectively drives the pressure plates 30*ap* and 30*bp* is formed on the main shaft inner cylinder 31*a*, the clutch portion outer cylinder 31*c*, and the clutch cover 178.

When the friction plate group 30*af* is pressurized by the pressure plate 30*ap*, the first clutch 30*a* engages, power input to the primary driven gear 29 is transferred to the main shaft inner cylinder 31*a*, and the drive transmission gears 31*g* for the odd numbered shift stages rotate.

When the friction plate group 30*bf* is pressurized by the pressure plate 30*bp*, the second clutch 30*b* engages, power input to the primary driven gear 29 is transferred to the main shaft outer cylinder 31*b*, and the drive transmission gears 31*g* for the even numbered shift stages rotate.

Two of the six drive transmission gears 31*g* are shifter gears that slide in the axial direction, and two of the six driven transmission gears 32*g* are shifter gears that slide in the axial direction.

Shift forks 33*c* and 33*c* that move the two shifter gears on the counter shaft 32 are axially supported on a shift fork shaft 33*ca*. Similarly, as illustrated in FIG. 7, shift forks 33*m* and 33*m* that move the two shifter gears on the main shaft 31 are axially supported on a shift fork shaft 33*ma*.

The four shift forks 33*m* and 33*c* shift gears by moving, guided by a guide groove formed on the outer peripheral surface, according to the rotation of a shift drum 34. The shift drum 34 rotates according to a shifting motor 35.

The driving force of the shifting motor 35 is transferred to rotation of a shift spindle 37 via a speed reduction gear mechanism 36. The rotation of the shift spindle 37 is transferred to rotation of the shift drum 34 via an intermittent feeding mechanism 38. Therefore, the main transmission Tm can change speed by smoothly shifting gears from first gear to sixth gear by hydraulic control of the twin clutch 30 and by drive control of the shifting motor 35.

The output shaft of the main transmission Tm is the counter shaft 32, and the counter shaft 32 passes through a front side wall of the crankcases 22 and 23. A main transmission output gear 39 is fitted onto the protruding front end.

The power unit P provides a secondary transmission Ts located in front of the main transmission Tm. The secondary transmission Ts is configured internally of a combined front secondary transmission case 41 and a rear secondary transmission case 42. The secondary transmission Ts is provided with a cam type torque damper 52.

A transmission drive shaft 61, a transmission driven shaft 71 (also referred to as the output shaft), and other rotating shafts such as a damper shaft 51 that supports a cam type torque damper 52, are parallel to the crankshaft 21 (i.e. directed in the front and back direction). The front and the back ends of these shafts are constructed to be axially supported by the front secondary transmission case 41 and the rear secondary transmission case 42.

The damper shaft 51 corresponds to the input shaft of the secondary transmission Ts. A secondary transmission input gear 50 is fitted to an end portion of the damper shaft 51 protruding rearward of the rear secondary transmission case 42. The secondary transmission input gear 50 meshes with the main transmission output gear 39, and the output of the main transmission Tm is input into the secondary transmission input gear 50 of the secondary transmission Ts. The cam type torque damper 52 is provided on the rear half portion of the damper shaft 51. Specifically, a cam member 53 on the rear half portion of the damper shaft 51 is spline fit for axial movement. A cam follower gear member 54 that faces rearward of the cam member 53 is supported with relative rotational ability on the damper shaft 51 with travel in the axial direction regulated, and cam member 53 is biased toward the cam follower gear member 54 by a coil spring 55. The cam type torque damper 52 is configured so that a protruding cam surface of the cam member 53 contacts a recess of the cam follower gear member 54.

Accordingly, even if the torque input to the damper shaft 51 from the secondary transmission input gear 50 suddenly increases or decreases, a buffering action works between the cam member 53 and the cam follower gear member 54. The buffering action suppresses the effects on the transmission mechanism on the downstream side of the cam follower gear member 54 to facilitate a smooth shift change.

An intermediate cylindrical gear member 57 is rotatably supported on a front damper shaft 51*f* with free relative rotation. A large idle gear 57*a* and a small idle gear 57*b* are integrally formed on the front and back of the intermediate cylindrical gear member 57.

Of the transmission drive shaft 61 and the transmission driven shaft 71 where mutual transmission gears of the secondary transmission Ts mesh, the transmission drive shaft 61 is installed parallel in the same position in the axial direction below the damper shaft 51. A drive shaft input gear 60 is spline fit in a fixed position on the rear part of the transmission drive shaft 61 and meshes with the cam follower gear member 54, and the motive power via the cam type torque damper 52 is input into the transmission drive shaft 61.

On the transmission drive shaft 61, a high speed drive gear 62 adjacent to the front side of the drive shaft input gear 60 of the rear portion is rotatably supported, a low speed drive gear 65 in the center is rotatably supported, and a reverse drive gear 68 in the front portion is rotatably supported. A high and low speed switching clutch mechanism, including a high and low speed switching shifter member 63, is provided between the high speed drive gear 62 and the low speed drive gear 65.

Moving the high and low speed switching shifter member 63 rearward engages the high speed drive gear 62 to rotate the high speed drive gear 62 together with the transmission drive shaft 61. Moving the high and low speed switching shifter member 63 forward engages the low speed drive gear 65 to rotate the low speed drive gear 65 together with the transmission drive shaft 61. When the high and low speed switching shifter member 63 is positioned in the center so as not to engage either gear, the rotation of the transmission drive shaft 61 is not transferred to either the high speed drive gear 62 or the low speed drive gear 65.

A forward and reverse switching clutch mechanism, including a forward and reverse switching shifter member 66, is provided between the low speed drive gear 65 and the reverse drive gear 68. If the forward and reverse switching shifter member 66 is positioned rearwardly, there is no counterpart to engage. The rotation of the transmission drive shaft 61 is transferred only to the high speed drive gear 62 or the low speed drive gear 65 via the high and low speed switching shifter member 63 and is not transferred via the forward and reverse switching shifter member 66. Moving the forward and reverse switching shifter member 66 forward engages the reverse drive gear 68 to rotate the reverse drive gear 68 together with the transmission drive shaft 61.

The reverse drive gear 68 meshes with the large idle gear 57*a* of the intermediate cylindrical gear member 57. Further, a parking gear 69 adjacent to the front of the reverse drive gear 68 is provided on the transmission drive shaft 61 by being fitted to the reverse drive gear 68.

A transmission driven shaft 71 (also referred to herein as "output shaft") is installed parallel to the transmission drive shaft 61 to the right of the transmission drive shaft 61 with the damper shaft 51 installed above the transmission drive shaft 61. A high speed driven gear 72 is spline fit to a fixed position on a rear portion of the transmission driven shaft 71. A low speed driven gear 75 is spline fit in a central fixed position of the transmission driven shaft 71. Therefore, the high speed driven gear 72 and the low speed driven gear 75 integrally rotate with the transmission driven shaft 71 in a predetermined axial position.

The high speed driven gear 72 and the low speed driven gear 75 always mesh respectively with the high speed drive gear 62 and the low speed drive gear 65. Further, the low speed driven gear 75 also meshes with the small idle gear 57*b* of the intermediate cylindrical gear member 57. Therefore, the rotation of the reverse drive gear 68 on the transmission drive shaft 61, via the large idle gear 57*a* and the small idle gear 57*b* of the intermediate cylindrical gear member 57 on the damper shaft 51, makes the rotational direction a reverse direction and transfers to the low speed driven gear 75 to thereby rotate the transmission driven shaft 71 in the reverse direction.

The transmission driven shaft 71 is an output shaft of the secondary transmission Ts having front and back ends respectively protruding from the front secondary transmission case 41 and the rear secondary transmission case 42 of the secondary transmission Ts. In other words, the front end of the transmission driven shaft (output shaft) 71 is coupled to the front drive shaft 6, and the back end of the transmission driven shaft 71 is coupled to the rear drive shaft 8, to transfer motive power the front wheels 2, 2 and the rear wheels 3, 3.

Figure 3:
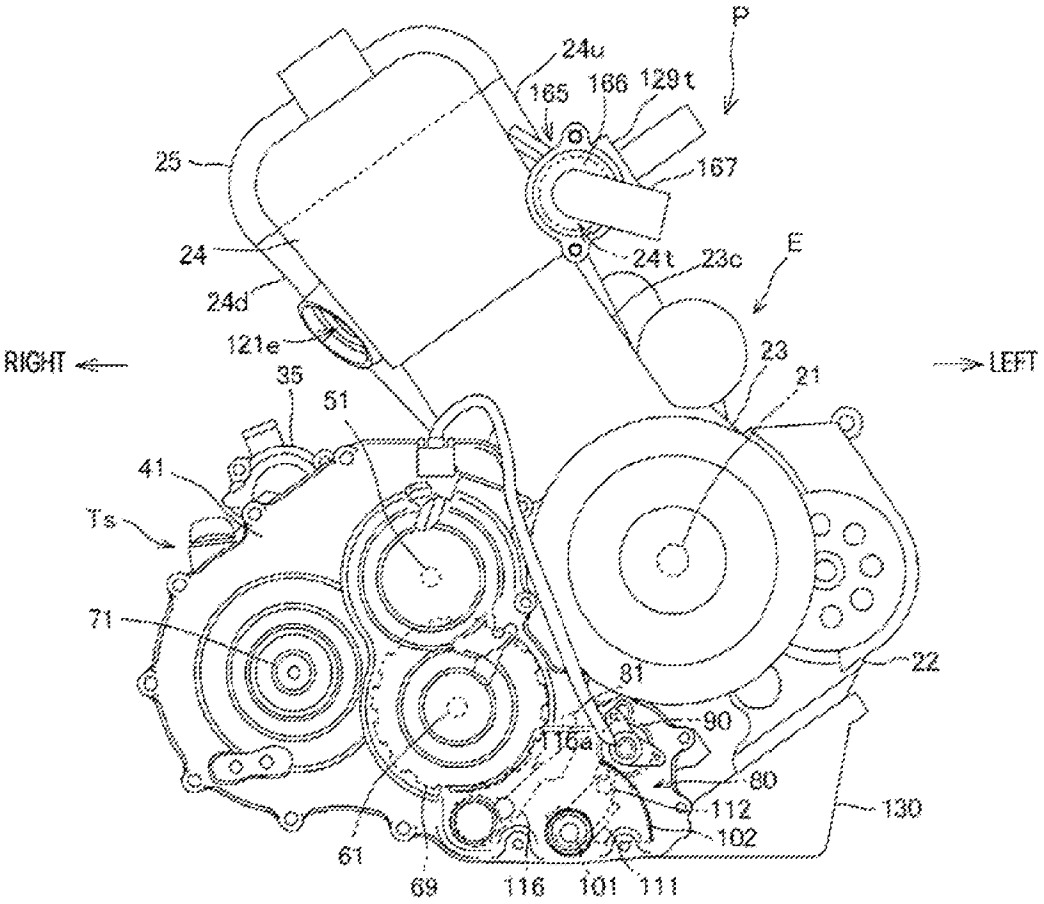
FIG. 3 is a front view of the power unit of FIG. 2.

A transmission drive mechanism 80 that moves the high and low speed switching shifter member 63 on the transmission drive shaft 61 and the forward and reverse switching shifter member 66 in the axial direction is provided on the left side of the transmission drive shaft 61 (right side in FIG. 3, i.e., on the crankshaft 21 side). A shift fork shaft 81 has front and back ends respectively supported by the front secondary transmission case 41 and the rear secondary transmission case 42. Shift forks 82, 83 are supported on the shift fork shaft 81 for receipt in shift fork grooves of the high and low speed switching shifter member 63 and the forward and reverse switching shifter member 66, respectively.

A shift drum 90 is provided further to the left of the shift fork shaft 81 (see FIG. 3). Two guide grooves 91*f*, 91*r* having required shapes in the circumferential direction are provided in the front and back on an outer peripheral surface of the shift drum 90. Engagement pin portions of the shift forks 82 and 83 are slidingly engaged with the guide grooves 91*f* and 91*r*. The shift forks 82 and 83 are respectively guided in the guide grooves by the rotation of the shift drum 90 to travel in the axial direction and move the high and low speed switching shifter member 63 and the forward and reverse switching shifter member 66 to perform a shift change.

With reference to FIG. 3 and FIG. 5, a shift spindle 101 located below the shift fork shaft 81 is rotatably supported with a front end passing through a shaft hole 48*fh* of the front secondary transmission case 41 and a back end fitting into a shaft hole of rear secondary transmission case 42. The shift spindle 101 rotates by the action of a manual shifting operation applied to the front end of the shift spindle 101. A gearshift arm 102 in a fan shape is fitted in a predetermined position of the shift spindle 101. The gearshift arm 102 meshes with a shift drum input gear 95 fitted on a drum support shaft 92 of the shift drum 90.

Further, a parking operation arm 111 is pivotably supported by the shift spindle 101. Rotation of the shift spindle 101 is transferred to pivoting of the parking operation arm 111 via a torsion spring 113, which is mounted between the shift spindle 11 and the parking operation arm 111. A roller 112 is rotatably supported on the tip of the parking operation arm 111.

A parking lock lever 116 is pivotably supported below the transmission drive shaft 61 on the right side of the shift spindle 101 (see FIG. 3). A locking protuberance 116*a* that locks in a groove between the teeth of the parking gear 69 is formed on the parking lock lever 116. When the parking operation arm 111 pivots by the rotation of the shift spindle 101 and the roller 112 on the tip of the parking operation arm 111 abuts the parking lock lever 116 and rolls, the parking lock lever 116 pivots and the locking protuberance 116*a* engages in a groove between the teeth of the parking gear 69 to lock the parking gear 69 and prohibit rotation.

With reference to FIG. 7, there is shown a rear view of the internal combustion engine E after components including a casing member 140 on the back side of the internal combustion engine E are removed to expose the crankcases 22 and 23. When the internal combustion engine E has a horizontal attitude, as described above, the right side of the dividing surface S of the vertically split upper crankcase 23 and lower crankcase 22 inclines downwardly. The cylinder portion 23*c* of the upper crankcase 23 is formed so that the cylinder axial line L of the cylinder Cy is orthogonal to the inclined dividing surface S (i.e., oblique to horizontal). The cylinder head 24 is overlaid onto the cylinder portion 23*c* on a mated surface that is parallel to the dividing surface S of the cylinder portion 23*c*.

The obliquely inclined cylinder head 24 has an intake port 121*i* that extends upward by curving from the combustion chamber 120 formed between a top surface of the piston 26 for each cylinder and an exhaust port 121*e* that extends downward by curving from the combustion chamber 120. The intake port 121*i* opens to an upper side surface 24*u* facing obliquely upward of the cylinder head 24. The exhaust port 121*e* opens to a lower side surface 24*d* facing obliquely downward of the cylinder head 24 (see FIG. 7). An intake pipe 122*i* is connected to the opening of the intake port 121*i* and an exhaust pipe 122*e* is connected to the opening of the exhaust port 121*e*.

The combustion chamber side opening of the intake port 121*i* is opened and closed by an intake valve 123*i*, and the combustion chamber side opening of the exhaust port 121*e* is opened and closed by an exhaust valve 123*e*. A valve mechanism 125 including an intake camshaft 126*i* and an exhaust camshaft 126*e* directed parallel to the crankshaft 21 is provided above the cylinder head 24. An intake cam of the intake camshaft 126*i* contacts a valve lifter 124*i* on an upper end of the intake valve 123*i* and an exhaust cam of the exhaust camshaft 126*e* contacts a valve lifter 124*e* on an upper end of the exhaust valve 123*e*. The intake cam and the exhaust cam move the intake valve 123*i* and the exhaust valve 123*e* by the rotation of the intake camshaft 126*i* and the exhaust camshaft 126*e* to open the valves (see FIG. 7).

Figure 15:
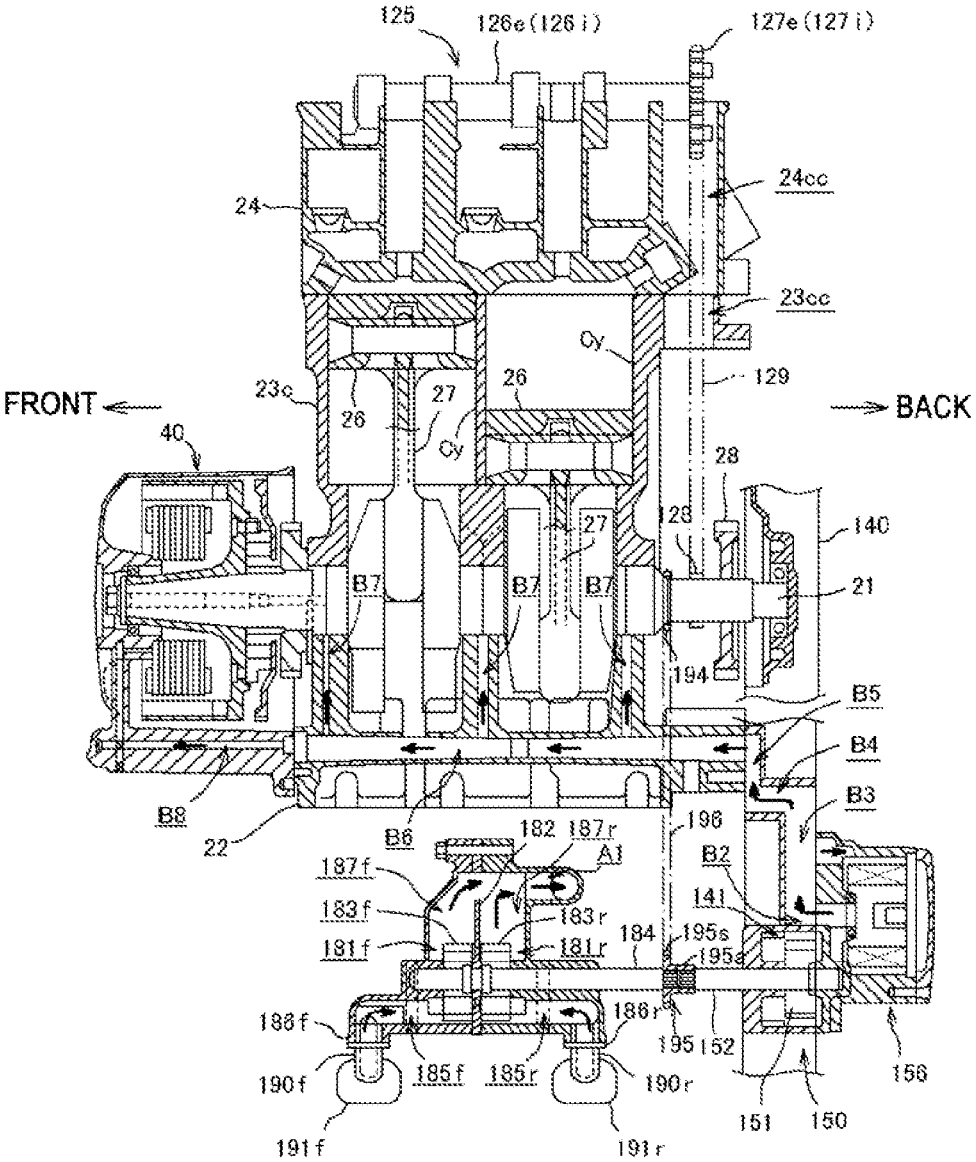
FIG. 15 illustrates a lubricant structure.

With reference to FIG. 15, cam chain chambers 24*cc* and 23*cc* are formed along a back side wall of the cylinder portion 23*c* of the upper crankcase 23 and the cylinder head 24. Driven sprockets 127*i* and 127*e*, which are respectively fitted to back ends of the intake camshaft 126*i* and the exhaust camshaft 126*e* and directed in the front and back direction face the cam chain chambers 24*cc* and 23*cc*. A cam chain 129 installed in the cam chain chambers 24*cc* and 23*cc* is wrapped around a drive sprocket 128 fitted near a back end of the crankshaft 21 and the driven sprockets 127*i* and 127*e*.

Accordingly, the rotation of the crankshaft 21 is transferred to the intake camshaft 126*i* and the exhaust camshaft 126*e* via the cam chain 129, and the intake valve 123*i* and the exhaust valve 123*e* slide at a predetermined timing by the rotation of the intake camshaft 126*i* and the exhaust camshaft 126*e* to open the valves. An AC generator 40 is provided on the front end where the crankcases 22 and 23 of the crankshaft 21 protrude forward (see FIG. 15).

Figure 14:
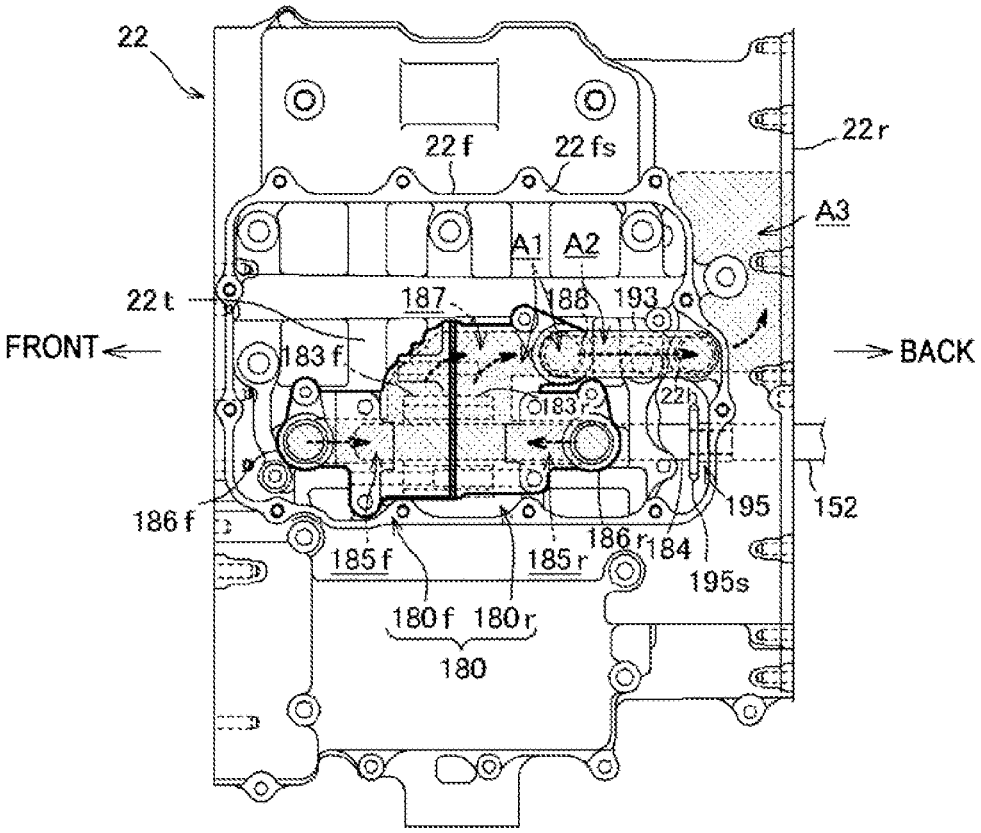
FIG. 14 is a bottom view of one embodiment of the crankcase.

With reference to FIG. 7 and FIG. 14, on a side of the lower crankcase 22, where the dividing surface S with the upper crankcase 23 is inclined, the lower crankcase 22 protrudes where the lower end is constrained into a rectangular frame wall 22*f*. An open end surface 22*fs* of the rectangular frame wall 22*f*, which is parallel to the dividing surface S, is therefore inclined. An oil pan 130 is attached from below to the open end surface 22*fs* of the rectangular frame wall 22*f* of the lower end of the lower crankcase 22 so as to cover the opening of the rectangular frame wall 22*f*.

The oil pan 130, having an inclined rectangular open end surface that corresponds to the open end surface 22*fs* of the rectangular frame wall 22*f*, is a container for collecting oil. The oil pan 130 includes triangular front and rear vertical walls 130*f* and 130*r* where the front and rear edges of the rectangular opening make up one edge, respectively. The oil pan 130 also includes a horizontal bottom wall 130*h* connected between the other horizontal edges of the front and rear vertical walls 130*f* and 130*r*, and an inclined wall 130*s* further connected between other inclined edges of the front and rear vertical walls 130*f* and 130*r* (see FIG. 3, FIG. 4, and FIG. 7). When the oil pan 130 is attached to the inclined open end surface 22*fs* of the rectangular frame wall 22*f* of the lower end of the lower crankcase 22, the bottom wall 130*h* is horizontal.

A back surface of the upper crankcase 23 and lower crankcase 22 is joined by the inclined dividing surface S. As illustrated in FIG. 7, a large space is enclosed by rearward protruding rear frame walls 23*r* and 22*r*, and end surfaces of rear frame walls 23*r* and 22*r* form a continuous surface. The main shaft 31 protrudes from the back surface of the upper crankcase 23 while a balancer shaft 131 on the front of the crankshaft 21 protrudes from the back surface of the lower crankcase 22, within the rear frame walls 23*r* and 22*r*. The aforementioned primary drive gear 28, along with a drive sprocket 128 and a drive sprocket 194, are fitted to the protruding back end portion of the crankshaft 21. The twin clutch 30 is located on the protruding back end portion of the main shaft 31.

A casing member 140 is overlaid and aligned to the rear frame walls 23*r* and 22*r* of the back surfaces of the upper crankcase 23 and the lower crankcase 22 so as to abut against a vertical end surface thereof. A cover member 170 and a clutch cover 178 are further placed over the back surface of the casing member 140. The width of casing member 140 in the crankshaft direction (i.e. front and back direction) is substantially constant. The casing member 140 functions as a spacer provided on the crankcases 22 and 23 and the cover member 170 so as to be interposed by contacting respective facing surfaces on both sides that are orthogonal to the crankcase 21. The casing member 140 can be formed of an aluminum alloy material with favorable thermal conductivity.

Figure 9:
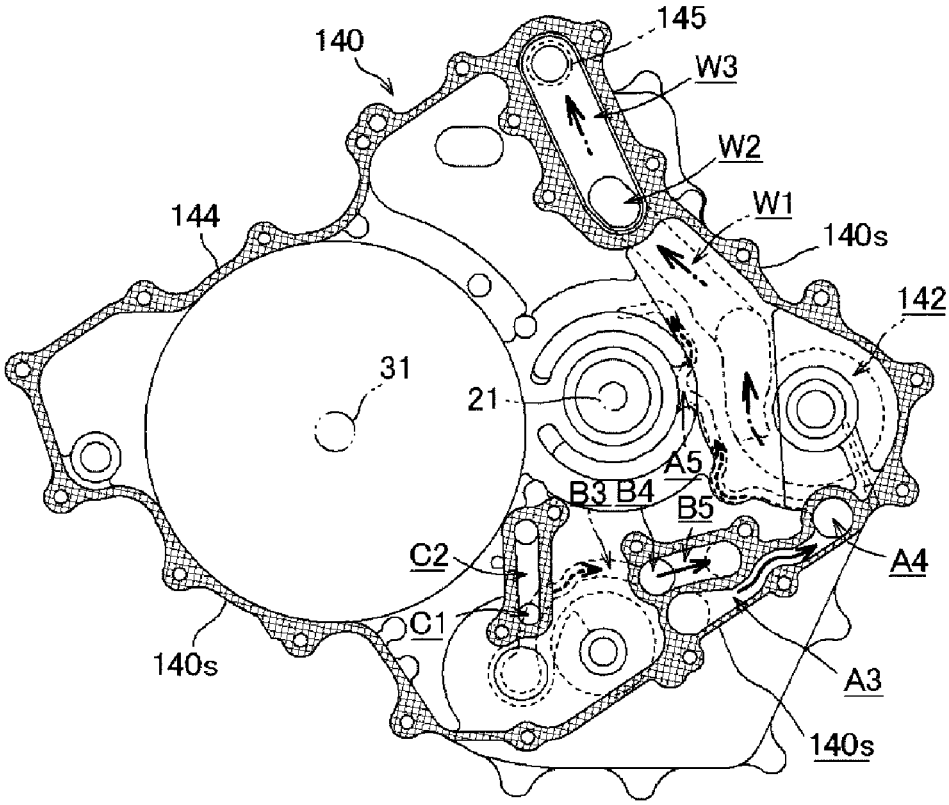
FIG. 9 is a front view of the casing member of FIG. 8.

A front frame wall 140*s* of the casing member 140 that forms a vertical end surface that corresponds to the vertical end surface of the rear frame walls 23*r* and 22*r* of the back surfaces of the upper crankcase 23 and the lower crankcase 22 is formed on the front surface of the casing member 14 (see FIG. 9). The casing member 140 includes a feed pump chamber 141 in which a rotor 151 for a feed pump 150 of a lubrication system (also referred to herein as an "oil pump") is inserted and, a water pump chamber 142 in which an impeller 161 for a water pump 160 of a cooling system is inserted. The casing member 140 also includes an oil chamber 143 and a clutch case portion 144.

Figure 8:
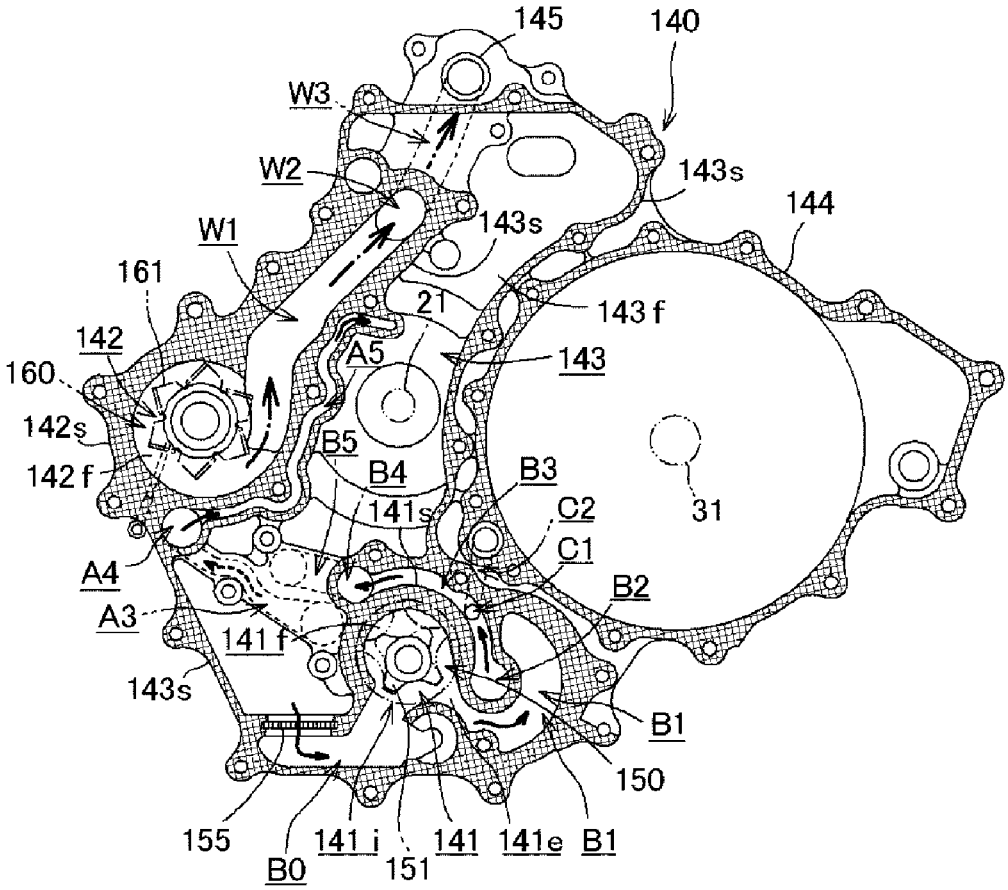
FIG. 8 is a rear view of one embodiment of the casing member.

The clutch case portion 144, as viewed in the crankshaft direction of FIG. 8, is substantially circular in cross section and is centered around the main shaft 31 on the right side portion of the casing member 140. A vertically long oil tank chamber 143 extending generally in the vertical direction through a position that overlaps with the crankshaft 21, when viewed in the crankshaft direction (i.e., along an axis of the crankshaft), is formed along the clutch case portion 144 on the left side of the clutch case portion 144.

With reference to FIG. 8, which is a rear view of the casing member 140, the water pump chamber 142 is located at substantially the same height as the crankshaft 21 to the left side of the oil tank chamber 143. The feed pump chamber 141 is located below the oil tank chamber 143 and towards the right side with respect to a lower portion of the oil tank chamber 143. The oil tank chamber 143 defines a vertically long recess having a rearward opening with the perimeter of a vertical front wall 143*f* enclosed by a frame wall 143*s*. The feed pump chamber 141 and the water pump chamber 142 also defines recesses having rearward openings with perimeters of the front walls 141*f* and 142*f* closed by arc shaped frame walls 141*s* and 142*s*.

Accordingly, the feed pump chamber 141, the water pump chamber 142, and the oil tank chamber 143 are mutually located in substantially the same axial position with respect to the engine (i.e., in the crankshaft direction) and are recesses that open rearward. The rearward openings of the recesses are closed by the cover member 170.

The feed pump (i.e. oil pump) 150 is a trochoid pump, and the rotor 151 inserted in the feed pump chamber 141 combines an inner rotor and an outer rotor. The inner rotor is integral with a feed pump shaft 152 rotatably supported and directed in the front and back direction. The impeller 161 inserted in the water pump chamber 142 is integral with a water pump shaft 162 rotatably supported and directed in the front and back direction. The water pump shaft 162 is coaxial with the balancer shaft 131 and has a structure that rotates together by linking with the balancer shaft 131.

On the back surface of the casing member 140, with reference to FIG. 8, a water discharge passage W1 extends along the oil tank chamber 143 obliquely upward to the right from the water pump chamber 142. The water discharge passage W1 is partitioned from the oil tank chamber by a common frame wall 143*s* between the discharge passage and the oil tank chamber 143. The upper end of the water discharge passage W1 connects to a water hole W2 that passes through to the front. As illustrated in FIG. 9, which is a rearview of the casing member 140, a coolant passage W3 is formed in the shape of a groove extending upwardly from the through water hole W2.

The coolant passage W3 has an upper end located above the frame wall 143*s* of the oil tank chamber 143. An inflow connecting pipe 145 protrudes rearward from the upper end of the coolant passage W3. Further, a coolant passage W4 is formed on the cylinder portion 23*c* of the upper crankcase 23 to correspond to the upper end of the coolant passage W3 (see FIG. 7). Specifically, coolant from the coolant passage W3 merges with coolant that flows in from the inflow connecting pipe 145 at the upper end thereof to flow into the coolant passage W4 of the cylinder portion 23*c*. The coolant passage W4 of the cylinder portion 23*c* communicates with the water jacket W5 of the cylinder portion 23*c*, and the water jacket W5 of the cylinder portion 23*c* communicates with the water jacket W6 of the cylinder head 24.

With reference to FIG. 8, with respect to the back surface of the casing member 140, a hole with a strainer 155 therebetween is provided on the bottom part of the oil tank chamber 143. An oil intake passage B0 below the hole extends to an intake port 141*i* of the feed pump chamber 141. The oil tank chamber 143 communicates with the oil intake passage B0 of the feed pump 150 via the strainer 155. An oil discharge passage B1 extends upward in an arc shape after extending obliquely downward from an exhaust port 141*e* of the feed pump chamber 141.

An oil filter 156 is attached to the cover member 170 on the oil discharge passage B1 such that the oil discharge passage B1 defines an inflow port of the oil filter 156. An oil outflow port B2 is formed on the cover member 170 for the oil filter 156 on a central portion of the arc shaped oil discharge passage B1. An oil passage B3 is formed so as to circumvent the outer perimeter of the feed pump chamber 141 from the oil outflow port B2. The oil passage B3 passes through to the front by a through oil hole B4 on the left end of the oil passage B3.

As illustrated in FIG. 9, which is a rear view of the casing member 140, an oil passage B5 is formed on the back surface of the casing member 140 towards the left side (right side in FIG. 9) with respect to the through oil hole B4. A common oil passage B5 is formed on the back surface of a back side wall of the lower crankcase 22 that corresponds to the oil passage B5 of the casing member 140 (see FIG. 7). On the lower crankcase 22, a main oil passage B6 extends parallel to the crankshaft 21 from the left end of the oil passage B5 forward, and a branch oil passage B7 extends to each bearing portion of the crankshaft 21 from the main oil passage B6 (see FIG. 7 and FIG. 15). The main oil passage B6 further communicates from the front end to an oil passage B8 in a generator cover 43 of the AC generator 40 to arrive at lubrication portions of the AC generator 40 (see FIG. 15).

A through oil passage C1 branches forwardly from the oil passage B3 at an intermediate location of oil passage B3. The through oil passage C1 is perforated. An oil passage C2 extends upward from the through oil passage C1 to the back surface of the casing member 140 (see FIG. 9). Although not illustrated, the oil passage C2, further communicates with oil passages of the cylinder portion 23*c* and the cylinder head 24 so that oil is supplied for lubrication of the valve mechanism 125 and the like.

Further, with reference to FIG. 9 an oil passage A3 formed on the casing member 140 extends obliquely along the front frame wall 140*s* below the oil passage B5 on the front surface. A common oil passage A3 is formed on the back surface of the lower crankcase 22 that corresponds to the oil passage A3 (see FIG. 7). The oil passage A3 is an oil passage that pumps oil to the oil tank chamber 143. At an upper end of the oil passage A3, with reference to FIG. 8, a through oil passage A4 passes rearwardly to connect oil passage A3 to an oil passage A5 formed on the back from the through oil passage A4 in the frame wall 143*s* between the water discharge passage W1 and the oil tank chamber 143. The oil passage A5 extends obliquely upward along the water discharge passage W1.

Figure 10:
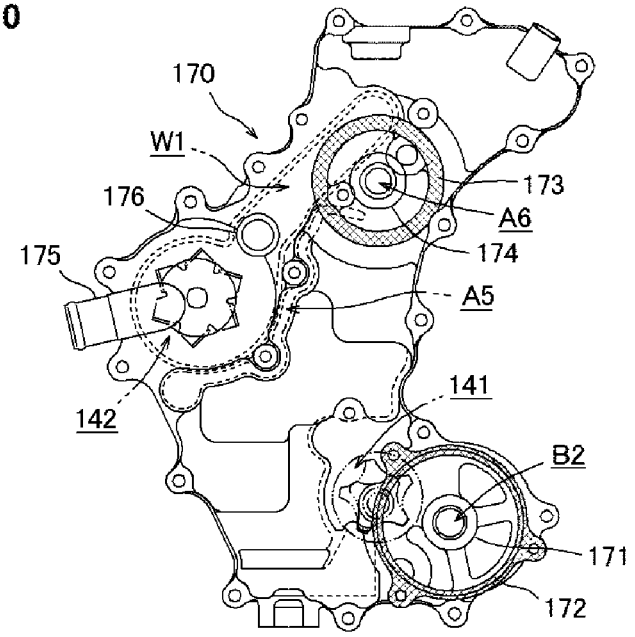
FIG. 10 is a rear view of one embodiment of an oil tank cover member.
Figure 11:
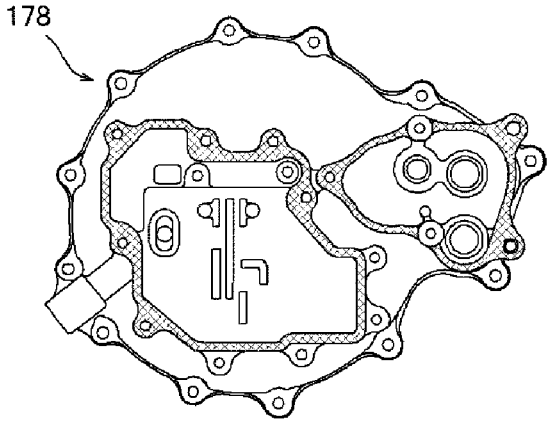
FIG. 11 is a rear view of one embodiment of a clutch cover member.

The attachment of the cover member 170 on the back surface of the casing member 140 closes the rearward openings of oil tank chamber 143, feed pump chamber 141, water pump chamber 142, as well as the oil intake passage B0, the oil discharge passage B1, the oil passage B3, the oil passage A5, and the like. With reference to FIG. 10, a cylinder portion 171 on the cover member 170 defines the oil outflow port B2 with the common oil flow outflow port B2 on the back surface of the casing member 140 connected to the oil passage B3. An annular oil filter base portion 172 formed on the back surface of cover member 170 around the cylinder portion 171 is attached to the oil filter 156.

When the oil filter 156 is attached to the oil filter base portion 172, the oil discharge passage B1 of the casing member 140 corresponds to an inflow port of the oil filter 156, and the oil discharged from the feed pump 150 flows from the oil discharge passage B1 to the oil filter 156. Oil purified by the filter element of the oil filter 156 flows out of the oil filter from the oil outflow port B2 to the oil passage B3.

Additionally, common water discharge passage W1 and oil passage A5 are formed on the front surface of the cover member 170 to correspond respectively to the water discharge passage W1 and the oil passage A5 of the casing member 140. An annular oil cooler base portion 173 is formed on the back surface of cover member 170 for attachment to an oil cooler 200. The oil cooler base portion is located in an upper portion of the cover (see FIG. 10) that includes a rearward outlet at an upper end of the oil passage A5 formed on the inner side of cover member 170. A cylinder portion 174 formed on the cover member 170 defines an oil outflow port A6 for oil cooler 200 that passes through the cover member 170. The cylinder portion 174 is located in the center of the oil cooler base portion 173.

A water absorption connecting pipe 175 is installed in a protruding manner on a portion of the cover member 142 that corresponds to the water pump chamber 142. The water absorption connecting pipe 175 is configured so that coolant is directed into the center of the water pump 160 from the rear. An outflow connecting pipe 176 protrudes rearwardly from the cover member 170 on a portion of the cover member that corresponds to a discharge port from the water pump chamber 142.

The oil cooler 200 immerses a cooler core in a water jacket of a cylindrical case 201. When the oil cooler is attached to the oil cooler base portion 173 of cover member 170, the outlet of the upper end of oil passage A5 connects to an inflow port of the cooler core. An outflow port of the cooler core is connected to the oil outflow port A6 of cover member 170 to communicate with the oil tank chamber 143.

Figure 6:
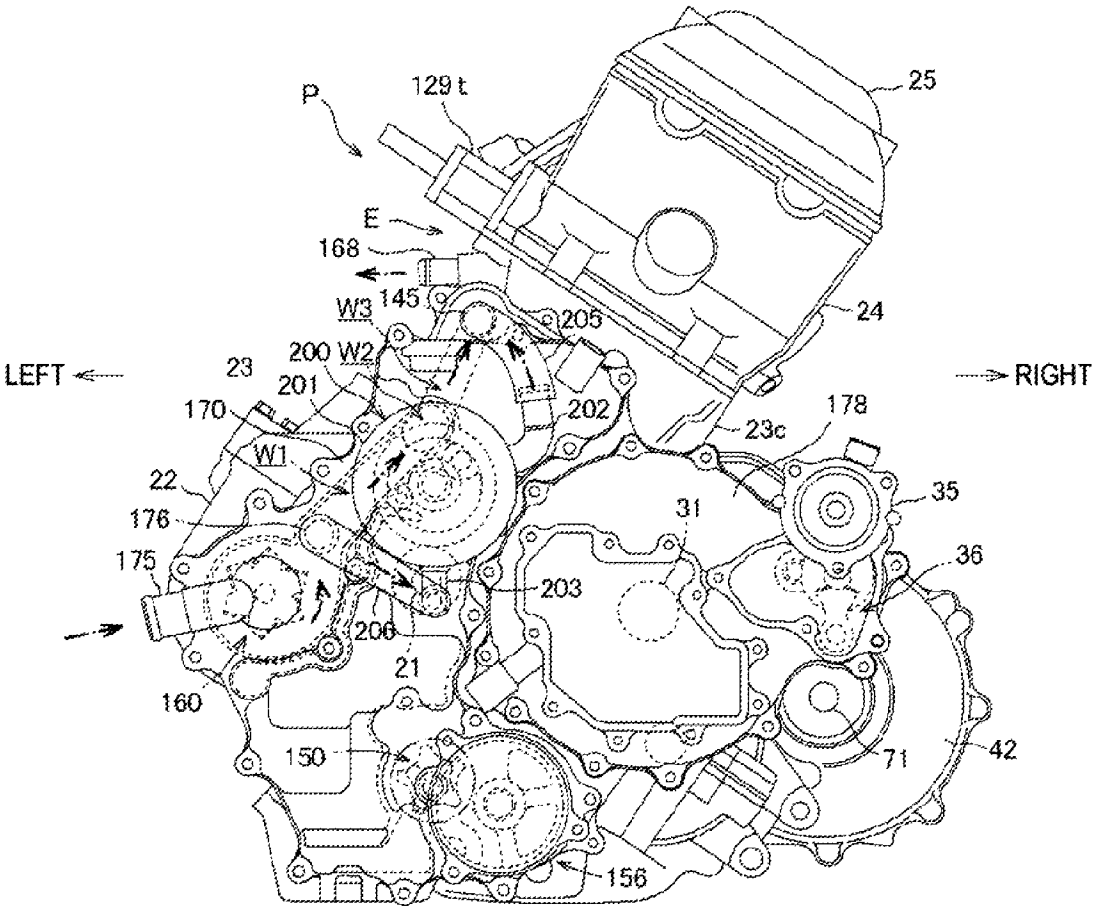
FIG. 6 is a rear view of the power unit of FIG. 2.

As illustrated in FIG. 6, an outflow connecting pipe 202 and an inflow connecting pipe 203 for coolant extend from the cylindrical case 201 of the oil cooler 200. The outflow connecting pipe 202 extends upwardly from the oil cooler and is coupled to the inflow connecting pipe 145 of the casing member 140 by a coupling pipe 205. The inflow connecting pipe 203 extends downwardly and is coupled to the outflow connecting pipe 176 of the cover member 170 by a coupling pipe 206.

Accordingly, a portion of the coolant discharged to the water discharge passage W1 by the water pump 160 is diverted to the outflow connecting pipe 176. The diverted coolant flows through the coupling pipe 206 and enters the water jacket of the oil cooler 200 from the inflow connecting pipe 203. Coolant that has cooled oil in the cooler core flows out of the oil cooler 200 from the outflow connecting pipe 202 to the coupling pipe 205 and merges with coolant in the coolant passage W3. The coolant from coolant passage W3 flows through the inflow connecting pipe 145 into coolant passage W4 of the cylinder portion 23 (see FIG. 6).

In the lower crankcase 22, an inner wall 22*t* that covers the crankshaft 21 from below extends parallel to the dividing surface S at an intermediate height between the dividing surface S at an upper end and the open end surface 22*fs* of the rectangular frame wall 22*f* at a lower end (see FIG. 7 and FIG. 14). A scavenge pump 180 is attached to the lower surface of the inner wall 22*t*. The internal combustion engine E employs a dry sump lubrication system supplying the oil tank chamber 143 in which oil is pumped to the oil tank chamber 143 by the scavenge pump 180.

The scavenge pump 180 includes a front scavenge pump 180*f* and a rear scavenge pump 180*r* as a pair of pumps.

FIG. 15 illustrates a cross-sectional view of the scavenge pump 180. The front and rear scavenge pumps 180*f* 180*r* respectively include pump chambers 181*f* and 181*r* partitioned by a partition wall 182. A front rotor 183*f* and a rear rotor 183*r* that sandwich the partition wall 182 are placed back to back to each other. A scavenge pump shaft 184 is directed in the front and back direction and is rotatably supported with the ability to rotate in common with the inner rotors of both rotors 183*f* and 183*r*. The scavenge pump shaft 184 protrudes rearwardly.

With reference to FIGS. 12 to 15, front and rear intake ports 185*f* and 185*r* of the scavenge pump 180 extend from the bottom portion of the pump chambers 181*f* and 181*r*, and the end portions of the intake ports 185*f* and 185*r* curve downward to form connecting ports 186*f* and 186*r*. Discharge ports 187*f* and 187*r* of the scavenge pump 180 extend to the left side and curve from an upper portion of the pump chambers 181*f* and 181*r*. The discharge ports 187*f* and 187*r* converge into one, having no partition wall 182 downstream, to become the oil discharge passage A1. The oil discharge passage A1, which extends rearwardly, forms a connecting port 188 by curving downwardly.

Pumping tubes 190*f* and 190*r* of the scavenge pump 180 are connected to the front and rear connecting ports 186*f* and 186*r* of the intake ports 185*f* and 185*r* to define the pumped oil passages A0 and A0. The lower ends of the pumping tubes 190*f* and 190*r* have end faces oriented with respect to the pumping tubes (see FIG. 7), and base plates 191*f* and 191*r* are attached to the oblique intake ports. Strainers 192*f* and 192*r* are provided midway in pumping tubes 190*f* and 190*r*.

Figure 4:
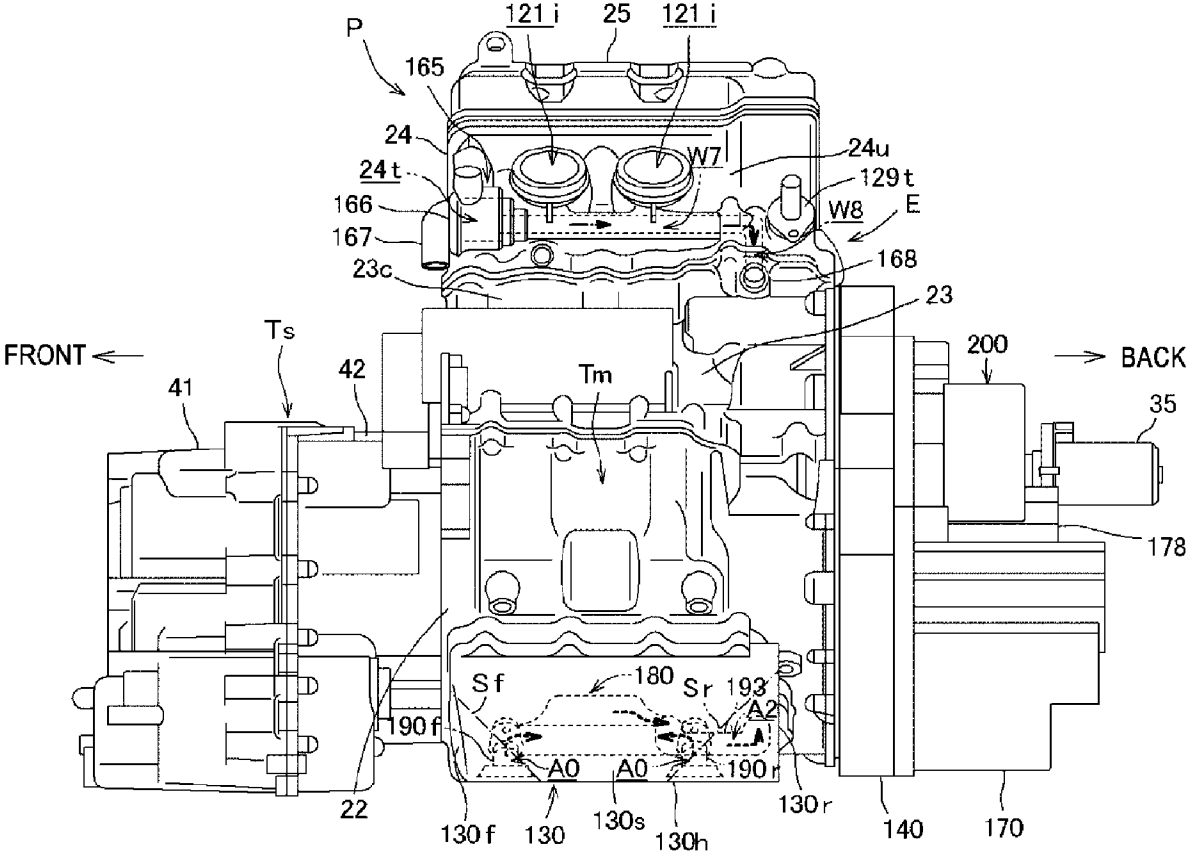
FIG. 4 is a left side view of the power unit of FIG. 2.

Referring to FIG. 7, the scavenge pump 180 is attached to the lower surface of the inner wall 22*t* parallel to the obliquely inclined dividing surface S of the lower crankcase 22. The front and rear pumping tubes 190*f* and 190*r* protrude into the oil pan 130 obliquely downward to the left. The base plates 191*f* and 191*r* at the lower end of the pumping tubes 190*f* and 190*r* are horizontal and are located adjacent to a horizontal bottom wall 130*h* of the oil pan 130. As illustrated in FIG. 4, the intake ports of the front and rear pumping tubes 190*f* and 190*r* are respectively placed adjacent the front and rear vertical walls 130*f* and 130*r* of the oil pan 130 so as to be mutually separated from each other.

With reference to FIG. 14 and FIG. 15, the rearward protruding scavenge pump shaft 184 is coaxial with a feed pump shaft 152 of the feed pump 150 included in the casing member 140.

The feed pump shaft 152, which protrudes forwardly from the feed pump chamber 141 of the casing member 140 passes through an opening formed in the back side wall of the lower crankcase 22 and is adjacent to the coaxial scavenge pump shaft 184.

A minor diameter end portion 152*e* having a spline groove that decreases in diameter is included at the front end of the feed pump shaft 152. A minor diameter end portion 184*e* having a spline groove that decreases in diameter is included at the back end of the scavenge pump shaft 184. Both minor diameter end portions 152*e* and 184*e* have equivalent major diameters. An input coupling member 195 couples the feed pump shaft 152 and the scavenge pump shaft 184.

With reference to FIG. 12, the input coupling member 195 has a cylinder portion 195*a* of a predetermined length, and a flange shaped sprocket portion 195*s* formed on an end portion thereof. Spline protrusions are formed on an inner circumferential surface of the cylinder portion 195*a* of the input coupling member 195. The minor diameter end portions 184*e*, 152*e* of the scavenge pump shaft 184 and the feed pump shaft 152 are spline fitted to the input coupling member 195 from the front and rear.

Therefore, the input coupling member 195 couples the scavenge pump shaft 184 and the feed pump shaft 152 with the ability to rotate in common. The location of the cylinder portion 195*a* of the input coupling member 195 at the end portions of scavenge pump shaft 184 and the feed pump shaft 152 positions the input coupling member 195 axially.

The scavenge pump shaft 184 is located below the crankshaft 21 and a drive sprocket 194 is mounted to a rear portion of the crankshaft 21 in the same axial position as the sprocket portion 195*s* of the input coupling member 195 (i.e., in the same position in the front and back direction, see FIG. 7 and FIG. 15). A pump drive chain 196 is wrapped on the drive sprocket 194 of crankshaft 21 and on the sprocket portion 195*s* of input coupling member 195. Therefore, the rotation of the crankshaft 21 is transferred to the input coupling member 195 via the pump drive chain 196, and the rotation of the input coupling member 195 integrally rotates the scavenge pump shaft 184 and the feed pump shaft 152 to drive the scavenge pump 180 and the feed pump 150 simultaneously.

The oil passage A3, as described above, protrudes forwardly on the lower portion of the rear frame wall 22*r* formed on the back side wall of the lower crankcase 22 (see FIG. 7). A connecting port 22*h* opens downwardly to a portion that enters into the rectangular frame wall 22*f* of the lower wall of the oil passage A3 (see FIG. 14). A U shape curved coupling pipe 193 couples the connecting port 22*h* and the connecting port 188 of the oil discharge passage A1 of scavenge pump 180 to configure an oil coupling passage A2 (see FIG. 12 and FIG. 14).

The front and rear scavenge pump 180*f* and 180*r* of scavenge pump 180 pumps oil that has collected in the oil pan 130 removing impurities by middle strainers 192*f* and 192*r* through the pumped oil passages A0 and A0 of the front and rear pumping tubes 190*f* and 190*r*.

Because the inlet ports of the front and rear pumping tubes 190*f* and 190*r* are mutually separated from each other in the oil pan 130, even if oil is disproportionately collected in one side of the oil pans 130 (e.g., if the vehicle to which the internal combustion engine E is mounted is significantly inclined to the front or rear), the scavenge pump on the lower side can easily pump the oil through the pumped oil passage A0 of the pumping tubes 190*f* and 190*r* (see FIG. 4).

FIG. 4 includes a dashed line to illustrate the lowest oil surfaces Sf and Sr where oil can be pumped when the internal combustion engine E is significantly inclined to the front or rear.

FIG. 4 illustrates the oil surface Sf for when the internal combustion engine E is significantly inclined forward to approximately 45° and illustrates the oil surface Sr for when it is inclined rearward. Oil that has disproportionately collected in the front of the oil pan 130 inclined forward, even if only a little oil has collected in the oil pan 130, can be pumped by the front scavenge pump 180*f* from a suction port lower than the oil surface Sf of the pumping tube 190*f*. Oil that has disproportionately collected in the rear of the oil pan 130 inclined rearward can be pumped by the rear scavenge pump 180*r* from a suction port lower than the oil surface Sr of the pumping tube 190*r*.

In this manner, because the oil can always be pumped by whichever of the pair of scavenge pumps 180*f* and 180*r* is on a relatively lower side, even if only a little oil has collected in the oil pan 130, the volume of the oil pan 130 can be reduced and each of the pumping tubes 190*f* and 190*r* can also have a shortened length. Efficiency of oil recovery can be increased and oil capacity can be reduced. The volume of the oil pan 130 can be reduced such that the size of the overall internal combustion engine E can be reduced.

In this manner, the oil pumped through the pumped oil passage A0 by the scavenge pump 180 is discharged from the discharge ports 187*f* and 187*r* to the oil discharge passage A1, passes through the oil coupling passage A2 of the coupling pipe 193 and enters the oil passage A3 (see FIG. 14). The oil then passes through the through oil passage A4 from the oil passage A3 of casing member 140 and is directed upwardly by the oil passage A5 to flow into the oil cooler 200 (see FIG. 7, FIG. 8, and FIG. 10). The oil cooled by the oil cooler 200 flows out from the oil outflow port A6 into the oil tank chamber 143 (see FIG. 4 and FIG. 10).

As illustrated in FIG. 8, because the oil passage A5 formed between the casing member 140 and the cover member 170 extends along the water discharge passage W1, the oil flowing in the oil passage A5 is effectively cooled by the coolant that flows in the water discharge passage W1 and is then supplied to the oil tank chamber 143.

The oil collected in the oil tank chamber 143 is directed to the oil intake passage B0 via the strainer 155 on the bottom portion of the oil tank chamber 143 by the driving of the feed pump 150. The oil is discharged to the oil discharge passage B1 and passed through the oil filter 156 to flow out from the oil outflow port B2 into the oil passage B3, and passes through the main oil passage B6 from the through oil hole B4 and the oil passage B5 to circulate in various bearing parts and the like of the crankshaft 21. The oil then passes through the through oil passage C1 and the oil passage C2 to circulate in the valve mechanism 125 and the like (see FIG. 8).

Referring to FIGS. 3 and 4, the cooling system includes a thermostat chamber 24*t* for a thermostat 165 located near a curved inner portion that becomes the bottom side of the intake port 121*i* cylinder head 24. Coolant that is circulated in the water jacket W6 of the cylinder head 24 flows out to the thermostat chamber 24*t*.

The forward opening thermostat chamber 24*t* is closed by a lid member 166. A connecting pipe 167 that communicates to the thermostat chamber 24*t* is equipped in a protruding manner on the lid member 166 (see FIG. 3 in FIG. 4). A radiator hose leading to a radiator, not illustrated, is connected to the connecting pipe 167. Further, a coolant bypass passage W7 that faces rearwardly and parallel to the crankshaft 21 from the thermostat chamber 24*t* of the cylinder head 24 is formed by passing through the curved inner portion below the intake port (see FIG. 4).

The cam chain chamber 24*cc* is formed on the back side of the cylinder head 24, and a chain tensioner 129*t* that gives tension to the cam chain 129 is attached to the back end of a left side surface (upper side surface 24*u*) of the cylinder head 24. The coolant bypass passage W7 is perforated facing the chain tensioner 129*t* and curves downwardly in front of the chain tensioner 129*t* to communicate with a coolant bypass passage W8 of the cylinder portion 23*c* of the upper crankcase 22 (see FIG. 4 and FIG. 7).

Referring to FIG. 7, the coolant bypass passage W8 of the cylinder portion 23*c* is connected to the coolant bypass passage W7 by a mated surface with the cylinder head 24 and extends downwardly from the mated surface to open externally by curving to the left side. A bypass connecting pipe 168 is fitted to the opening. The water absorption connecting pipe 175 of the water pump 160 is coupled to the radiator and also coupled to the bypass connecting pipe 168.

Therefore, the coolant that circulates in the water jacket W5 of cylinder portion 23*c* and the water jacket W6 of cylinder head 24 is led to the thermostat chamber 24*t*. The coolant is then directed either through the radiator according to the thermostat 165 and then back to the water pump 160 or through a bypass water route that does not go through the radiator but detours and returns to the water pump 160.

In other words, when the internal combustion engine E has not warmed up, the thermostat 165 closes the water route to the radiator and opens the bypass water route to hasten engine warming. When the engine has warmed up, the thermostat 165 closes the bypass water route and opens the water route to the radiator so that coolant cooled by the radiator circulates in the water jackets W5 and W6 to cool the cylinder portion 23*c* and the cylinder head 24.

The casing structure of the automotive internal combustion engine according to the disclosure of this application in the embodiment described above will be further described below.

With reference to FIG. 7, the upper/lower divided crankcase structure is shown in which the crankshaft 21 and the first counter 32 (also sometimes referred to as a first transmission shaft) of the transmission Tm are axially supported on a dividing surface S of the upper crankcase 23 and the lower crankcase 22. The dividing surface S of the crankcases 22 and 23 is inclined so that the second main shaft 31 (also sometimes referred to as a second transmission shaft) axially supported by the upper crankcase 23 above the internal combustion engine and the counter 32 is lower than the crankshaft 21. The cylinder Cy is formed on the upper crankcase 23 so that the cylinder axial line L is orthogonal to the dividing surface S. The cylinder axial line L can be even more inclined with the dividing surface S without interfering with the cylinder portion 23*c* (cylinder Cy) even if the transmission case portion of the upper crankcase 23 bulges upward due to the twin clutch 30 and the like provided on the main shaft 31, thereby enabling the overall vertical dimension of the internal combustion engine E to be kept even smaller.

Further, because the cylinder Cy is formed on the upper crankcase 23 so that the cylinder axial line L is orthogonal to the dividing surface S, manufacturability, using a drilling process and the like, of the upper crankcase 23 and the lower crankcase 22 is favorable.

As illustrated in FIG. 7, because the cylinder axial line L of the cylinder Cy is offset to the transmission Tm side relative to the crankshaft 21, side pressure acting on the cylinder inner wall by the piston 26 through the connecting rod 27 can be mitigated, thereby reducing friction loss.

Because the cylinder axial line L is orthogonal to the dividing surface S, forming an offset cylinder where the cylinder axial line L is displaced from the crankshaft 21 in the crankcases 22 and 23 is easy and the present arrangement has favorable manufacturability.

With reference to FIG. 7, in the lower crankcase 22, because the inner wall 22*t* that covers the crankshaft 21 from below is formed parallel to the dividing surface S and the scavenge pump 180 is attached to the lower surface of the inner wall 22*t*, oil traveling on the inclined inner wall 22*t* parallel to the dividing surface S is easily collected in the oil pan 130 below the crankcase. The oil collected in the oil pan 130 is easily pumped by the scavenge pump 180 attached to the lower surface of the inner wall 22*t* relatively near to the oil pan 130 to thereby improve lubrication efficiency.

With further reference to FIG. 7, because a cylinder head 24 laid over the cylinder Cy of the upper crankcase 23 where the cylinder axial line L is inclined has an intake port 121*i*, extended curving from a combustion chamber 120, that opens to an upper side surface 24*u* facing obliquely upward of the cylinder head 24, and a thermostat chamber 24*t* that communicates with a water jacket W6 in the cylinder head 24 formed near a curved inner portion that becomes a bottom side of the intake port 121*i*, the thermostat chamber 24*t* formed on the upper side surface 24*u* facing obliquely upward of the cylinder head 24 inclined with the cylinder Cy is placed in the highest position of a cooling system route higher than the water jacket W5 of the cylinder Cy and the water jacket W6 of the cylinder head 24 so that air accumulated above the cooling system route can be guided to and collected in the thermostat chamber 24*t*. Therefore, air bleeding can be performed at the same time as maintenance on the thermostat chamber 24*t*, thereby also improving maintainability.

Moreover, forming the thermostat chamber 24*t* near the curved inner portion that becomes the bottom side of the intake port 121*i* prevents the cylinder head 24 from having to be large in size.

With reference to FIG. 4 and FIG. 5, the thermostat chamber 24*t* is formed on an end portion on a side opposite a cam chain chamber 24*cc* in a crankshaft direction of the cylinder head 24. The cylinder head 24 is not required to be large in size, and because a coolant bypass passage W7 is formed using a curved inner portion that is below the intake port 121*i* by passing through the curved inner portion parallel to the crankshaft 21 that faces the cam chain chamber 24*cc* side from the thermostat chamber 24*t*, a small scale cooling structure can be designed.

With reference to FIG. 7, an exhaust port 121*e*, extending curved from the combustion chamber 120, opens facing an upper space of the transmission Tm on a lower side surface 24*d* that faces obliquely downward of the cylinder head 24, an upper space is easily secured to the opening of the exhaust port 121*e* of the lower side surface 24*d* facing obliquely downward of the cylinder head 24 above the transmission Tm in a relatively lower position having the main shaft 31 and the counter shaft 32 positioned downward from the crankshaft 21, and the exhaust pipe 122*e* that extends linking to the opening of the exhaust port 121*e* can be easily and freely handled.

The foregoing description of embodiments and examples has been presented for purposes of illustration and description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent devices by those of ordinary skill in the art. Rather it is hereby intended the scope be defined by the claims appended hereto. Additionally, the features of various implementing embodiments may be combined to form further embodiments of the invention.

What is claimed is:

1. A casing structure of an internal combustion engine comprising an upper/lower divided crankcase structure in which a crankshaft and a first transmission shaft of a pair of transmission shafts parallel to the crankshaft of a transmission are supported at a dividing surface between an upper crankcase and a lower crankcase, an oil pan beneath the crankshaft having a bottom wall that is substantially horizontal when the internal combustion engine is installed for use in a vehicle, the dividing surface being inclined so that a second transmission shaft supported by the upper crankcase above the first transmission shaft is below the crankshaft when the bottom wall is substantially horizontal, a cylinder is formed in the upper crankcase so that a cylinder axial line is orthogonal to the dividing surface, and a balancer shaft supported by the lower crankcase on an opposite side portion of the lower crankcase as the first transmission shaft.

2. The casing structure of an internal combustion engine according to claim 1, wherein the cylinder axial line of the cylinder is offset to the transmission side relative to the crankshaft.

3. The casing structure of an internal combustion engine according to claim 1, wherein the lower crankcase has an inner wall that covers the crankshaft from below formed parallel to the dividing surface, and a scavenge pump is attached to a lower surface of the inner wall.

4. The casing structure of an internal combustion engine according to claim 1, wherein a cylinder head disposed over the cylinder of the upper crankcase with the cylinder axial line has an intake port extending curved from a combustion chamber that opens to an upper side surface facing obliquely upward of the cylinder head, and a thermostat chamber for a thermostat that communicates with a water jacket in the cylinder head formed near a curved inner portion that is a bottom side of the intake port.

5. The casing structure of an internal combustion engine according to claim 4, wherein the thermostat chamber is formed on an end portion on a side opposite a cam chain chamber in a crankshaft direction of the cylinder head, and a coolant bypass passage that passes through a curved inner portion that is below the intake port is formed parallel to the crankshaft from the thermostat chamber toward the cam chain chamber.

6. The casing structure of an internal combustion engine according to claim 4, wherein an exhaust port, extending curved from the combustion chamber, opens facing an upper space of the transmission on a lower side surface that faces obliquely downward of the cylinder head.

7. The casing structure of an internal combustion engine according to claim 1, wherein the crankshaft drives the second transmission shaft which drives the first transmission shaft.

8. A casing structure of an internal combustion engine comprising:

an oil pan having a bottom wall that is substantially horizontal when the internal combustion engine is installed for use in a vehicle;

a divided crankcase having an upper crankcase and a lower crankcase attachable together at a dividing surface, the divided crankcase configured for supporting a crankshaft and a first transmission shaft at the dividing surface, the upper crankcase configured for supporting a second transmission shaft above the first transmission shaft such that the second transmission shaft is parallel to the first transmission shaft and the second transmission shaft is below the crankshaft when the bottom wall is substantially horizontal and the oil pan is beneath the crankshaft;

a cylinder disposed in the upper crankcase such that an axial line of the cylinder is orthogonal to the dividing surface; and the lower crankcase is configured for supporting a balancer shaft on an opposite side portion of the lower crankcase as the first transmission shaft.

9. The casing structure of claim 8, wherein the divided crankcase is configured such that the dividing surface is inclined with respect to horizontal when the internal combustion engine is installed in a vehicle.

10. The casing structure of claim 9, further comprising a scavenge pump attached to a lower surface of the inner wall.

11. The casing structure of claim 8, wherein the cylinder extends over the first transmission shaft and the second transmission shaft.

12. The casing structure of claim 8, wherein the axial line of the cylinder is offset from an axis of the crankshaft in a direction toward the first transmission shaft.

13. The casing structure of claim 8, wherein the lower crankcase has an inner wall that covers the crankshaft from below, the inner wall disposed parallel to the dividing surface.

14. The casing structure of claim 8, further comprising a cylinder head disposed over the cylinder, a water jacket in the cylinder head, and a thermostat chamber for a thermostat that communicates with the water jacket.

15. The casing structure of claim 8, wherein the dividing surface is inclined with respect to the bottom wall.

16. A casing structure of an internal combustion engine comprising:

an oil pan having a bottom wall that is configured to be horizontal when the internal combustion engine is installed in a vehicle;

a divided crankcase having an upper crankcase and a lower crankcase attachable together at a dividing surface;

a crankshaft supported by the divided crankcase at the dividing surface, the crankshaft having a central axis;

a first transmission shaft supported by the divided crankcase at the dividing surface;

a second transmission shaft disposed above the first transmission shaft parallel to the crankshaft and the first transmission shaft, the second transmission shaft having a central axis that is lower than the central axis of the crankshaft when the bottom wall is substantially horizontal and the oil pan is beneath the crankshaft such that the internal combustion engine is positioned for use in the vehicle; and a balancer shaft supported by the lower crankcase on an opposite side portion of the lower crankcase as the first transmission shaft;

wherein the divided crankcase is configured such that the dividing surface is inclined with respect to the bottom wall.

17. The casing structure of claim 16, further comprising a cylinder disposed in the upper crankcase such that an axial line of the cylinder is orthogonal to the dividing surface.

18. The casing structure of claim 17, wherein the axial line of the cylinder is offset from the central axis of the crankshaft in a direction toward the first transmission shaft.

19. The casing structure of claim 16, wherein the lower crankcase has an inner wall formed parallel to the dividing surface, and a scavenge pump is attached to a lower surface of the inner wall.

20. The casing structure of claim 16, wherein a cylinder extends in the upper crankcase over the first transmission shaft and the second transmission shaft.

* * * * *